US007393245B2

(12) United States Patent
Palinkas et al.

(10) Patent No.: US 7,393,245 B2
(45) Date of Patent: Jul. 1, 2008

(54) INTEGRATED FILTER CONNECTOR

(75) Inventors: Raymond Palinkas, Canastota, NY (US); Noah Montena, Syracuse, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 11/803,438

(22) Filed: May 15, 2007

(65) Prior Publication Data

US 2007/0281542 A1 Dec. 6, 2007

Related U.S. Application Data

(62) Division of application No. 11/443,324, filed on May 30, 2006, now Pat. No. 7,278,887.

(51) Int. Cl.
*H01R 13/66* (2006.01)

(52) U.S. Cl. ..... 439/620.03

(58) Field of Classification Search ..... 439/620.03, 439/620.09, 620.1, 578, 620.22, 76.1
See application file for complete search history.

(56) References Cited

U.S. PATENT DOCUMENTS

| | | | |
|---|---|---|---|
| 1,928,408 | A | 9/1933 | Clavier |
| 2,652,544 | A | 9/1953 | Muchmore |
| 2,825,523 | A | 3/1958 | Bokum |
| 2,891,222 | A | 6/1959 | Freen |
| 3,048,780 | A | 8/1962 | Diambra et al. |
| 3,194,976 | A | 7/1965 | Ludwig et al. |
| 3,260,971 | A | 7/1966 | Bacher et al. |
| 3,538,464 | A | 11/1970 | Walsh |
| 3,546,638 | A | 12/1970 | Park |
| 3,569,915 | A | 3/1971 | Sorensen et al. |
| 4,079,343 | A | 3/1978 | Nijman |
| 4,083,022 | A | 4/1978 | Nijman |
| 4,126,370 | A | 11/1978 | Nijman |
| 4,144,509 | A | 3/1979 | Boutros |
| 4,451,803 | A | 5/1984 | Holdsworth et al. |
| 4,494,092 | A | 1/1985 | Griffin |
| 4,636,759 | A | 1/1987 | Ishikawa et al. |
| 4,679,013 | A | 7/1987 | Farrar et al. |
| 4,680,560 | A | 7/1987 | Yorita et al. |
| 4,701,726 | A | 10/1987 | Holdsworth |
| 4,845,447 | A | 7/1989 | Holdsworth |
| 4,901,043 | A | 2/1990 | Palinkas |
| 5,148,133 | A | 9/1992 | Zennamo, Jr. et al. |
| 5,150,087 | A | 9/1992 | Yoshie et al. |
| 5,278,525 | A | 1/1994 | Palinkas |
| 5,432,488 | A | 7/1995 | Kotani et al. |

(Continued)

OTHER PUBLICATIONS

U.S. Appl. No. 11/443,324, filed May 30, 2006, Palinkas et al.

*Primary Examiner*—Javaid Nasri
(74) *Attorney, Agent, or Firm*—Marjama Muldoon Blasiak & Sullivan LLP

(57) ABSTRACT

An integrated filter connector apparatus that performs the functions of a coaxial cable connector component combined with the functions of an in-line signal conditioning component. The apparatus eliminates at least one exposed point of connection between a separate coaxial cable connector component and an in-line signal conditioning component. Elimination of such a point of connection likely reduces RF ingress into a signal path and likely reduces interference with a signal traveling through the signal path. Embodiments of the connector apparatus provide various types of connector interfaces.

21 Claims, 17 Drawing Sheets

U.S. PATENT DOCUMENTS 5,440,282 A 8/1995 Devendorf et al.
6,165,019 A 12/2000 Kha et al.
6,794,957 B2 * 9/2004 Shafer et al. ..... 333/185

* cited by examiner

INTEGRATED FILTER CONNECTOR

FIELD OF THE INVENTION

This patent application is related to the field of cable connectors and in particular to an integrated filter connector that performs the functions of a coaxial cable connector component combined with the functions of an in-line signal conditioning component.

BACKGROUND OF THE INVENTION

CATV systems presently utilize a wide range of in-line filters, traps, attenuators, and other line conditioning equipment. The line conditioning equipment is used to maintain or improve the quality and to control the content of the network signal to an individual subscriber's premises. Conversely, the above equipment is also used in order to maintain, protect or condition the signals generated by devices within the subscriber's premises location and returned to the CATV network.

The ingress of RF energy is known to be a substantial factor in the degradation of the quality of the signals passed in each direction in a CATV network. Each connection (coupling) between a coaxial cable and the equipment in the distribution network is a potential point of ingress of RF energy that may interfere with the network signals. A particular source for RF ingress which is of concern to CATV system operators are low quality or poorly installed coaxial cable connectors, also referred to as coax cable connectors. Consequently, reducing the number of connectors and splices and improving the quality of the connections (couplings) between coaxial cable and distribution equipment reduces the opportunity of RF ingress.

Substantial advances have been made over the years in the art of coaxial connectors that provide improved RF shielding and moisture sealing, such as U.S. Pat. Nos. 5,470,257; 5,632,651; 6,153,830; 6,558,194; and 6,716,062; U.S. patent application Ser. No. 10/892,645, filed on Jul. 16, 2004; and U.S. patent application Ser. No. 11/092,197, filed on Mar. 29, 2005, all of which are assigned to John Mezzalingua Associates, Inc. of East Syracuse, N.Y. While such connectors are substantially less prone to installation errors, improper installation of the connector and improper seating (coupling) of the connector to an equipment port may still significantly contribute to signal interference from RF ingress.

While most of the foregoing line conditioning devices are installed to improve system performance on an existing network on an as-needed basis, their use is widespread enough that for some systems these devices are essentially standard with each new installation or service call and are therefore considered permanent. In such instances, it is not necessary for these devices to be separate, removable hardware, having traditional connector interfaces at each end thereof. In fact and in many instances, it is a general desire of the system operator to ensure that line conditioning devices are used and to make omissions or removal of these devices difficult for the installer.

SUMMARY OF THE INVENTION

It is therefore a desired object of the present invention to provide an integrated filter connector that performs the functions of a coaxial cable connector component combined with the functions of an in-line signal conditioning component. Elimination of a connection (coupling) between a coaxial cable connector component and a fitting on a typical in-line conditioning device component will result in reducing the potential for RF ingress into a signal path traveling through the integrated filter connector.

The advantages of incorporating an in-line device with a cable connector are not limited to regulating usage by the installers. Other advantages that become evident include elimination of ground contact points (as compared with a filter and connector that are joined conventionally) and moisture entry points, as well as reduced length, as compared with a non-integrated filter and connector.

As will be noted herein and according to the invention, many other types of connector components may be incorporated as well as many in-line device types.

BRIEF DESCRIPTION OF THE DRAWINGS

The objects and features of the invention can be better understood with reference to the claims and drawings described below. The drawings are not necessarily to scale, the emphasis is instead generally being placed upon illustrating the principles of the invention. Within the drawings, like reference numbers are used to indicate like parts throughout the various views. Differences between like parts may cause those parts to be indicated by different reference numbers. Unlike parts are indicated by different reference numbers.

For a further understanding of these and objects of the present invention, reference will be made to the following Detailed Description, which is to be read in connection with the accompanying drawings, in which.

DETAILED DESCRIPTION

Figure 1:
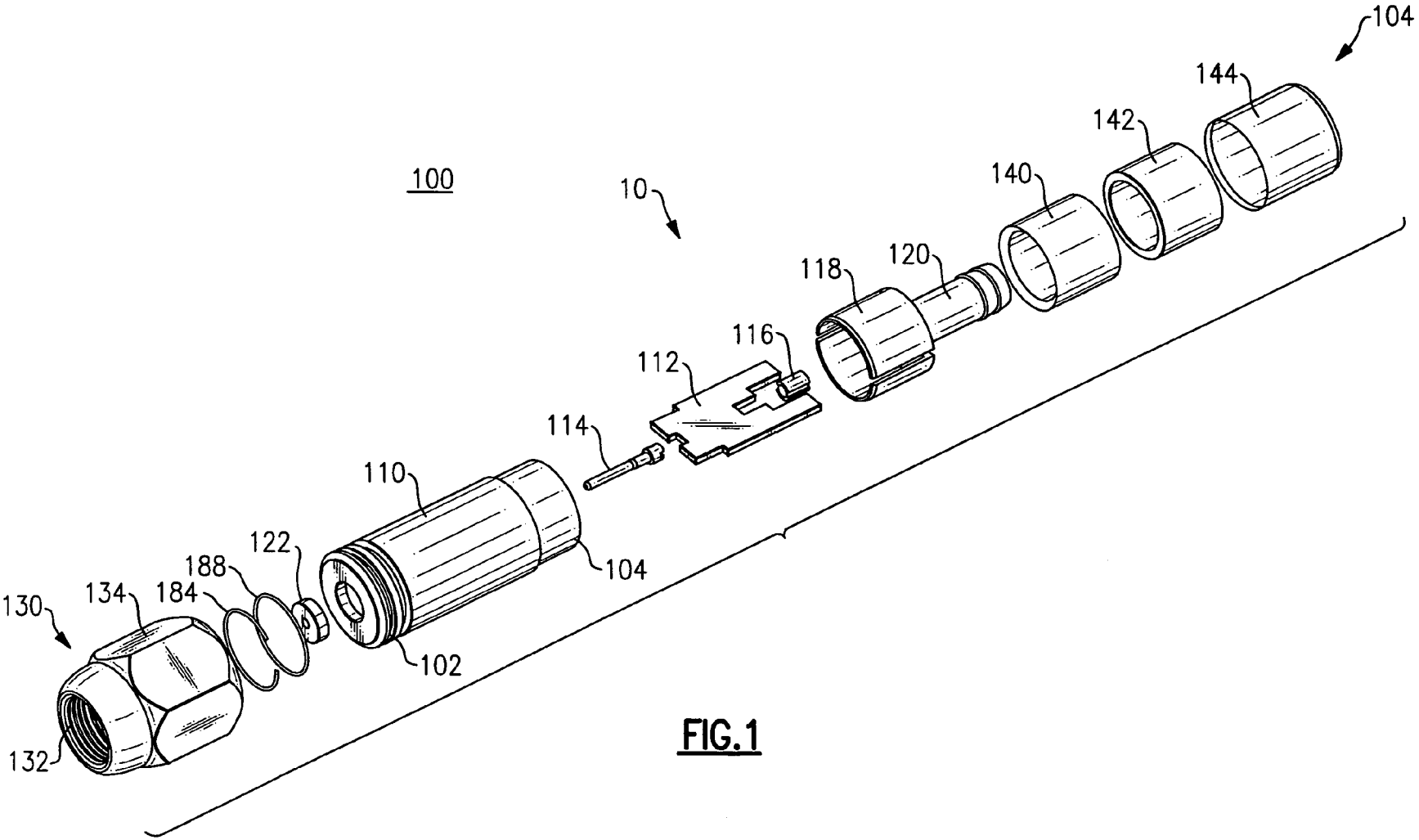
FIG. 1 is an exploded perspective view of a first embodiment of an unassembled integrated filter connector made in accordance with the present invention.

FIG. 1 is an exploded perspective view of a first embodiment of an unassembled integrated filter and connector assembly 10 made in accordance with the present invention. As shown, the integrated filter and connector assembly 10, also referred to as an integrated filter connector 10, includes a connector body 110 having a front body end (forward end) 102 and a rear body end (rear end) 104, which is configured to enclose an electric circuit which in one form can be a printed circuit board (PCB) 112 that performs in-line signal conditioning and that functions as part of an integrated signal filter assembly.

As assembled within the outer body 110, a post 120, including an attached circuit board support 118, is configured to receive and to provide mechanical support to the circuit board 112. The circuit board support 118 is constructed as a circular shaped member and includes slots 118*a* and 118*b*. The slots 118*a* and 118*b* are disposed at opposing locations along a circumference of the circular shaped member 118 and are oriented and dimensioned to receive and to provide mechanical support to the circuit board 112. When receiving the circuit board 112, the ground plane of the circuit board 112 may be electrically engaged with the post 120.

The circuit board 112 includes a forward electrode 114 and a rear electrode 116, also referred to as a front terminal 114 and a rear terminal 116, located at a first electrical end and a second electrical end respectively, of electrical circuitry residing within the circuit board 112. Typically, the forward electrode 114 is implemented as a contact pin 114 and the rear electrode is implemented as a collet 116. In some embodiments, the forward electrode is also implemented as a collet. The PCB 112 also includes a ground plane (not shown), a forward electrical contact pad (not shown) and a rear electrical contact pad (not shown) at each of two opposite ends. The forward electrical contact pad is in electrical contact with the forward electrode 114. The rear electrical contact pad is in electrical contact with the rear electrode 116. An insulator 122 is configured to surround and insulate the contact pin 114 from the outer body 110. As shown, the insulator 122 is shaped as a disk 122 and is typically made of a compressible insulating material.

The PCB 112 includes electrical components that collectively perform signal conditioning (processing) of a signal traveling between the forward electrode (contact pin) 114 and the rear electrode (collet) 116. Signal conditioning includes various forms of signal filtering performed by electrical components included within one or more filtering circuits residing on the PCB 112. Such filtering circuits are collectively included within what is referred to as a filter assembly. Additional details relating to the exemplary filter assembly described herein are provided in U.S. Pat. Nos. 6,794,957 and 6,476,688, the relevant parts of which are herein incorporated by reference.

A nut 130 including internal threads 132 may be rotationally attached to the outer body 110 at the forward end 102 of the integrated filter connector 10 and is configured to rotate independently of the outer body 110. The nut 130 includes a plurality of exterior flats 134, that enable the nut 130 to be engaged by a tool, such as a wrench (not shown). The nut 130 is configured to engage an externally threaded port (not shown), such as one included within a cable television distribution box.

Figure 2:
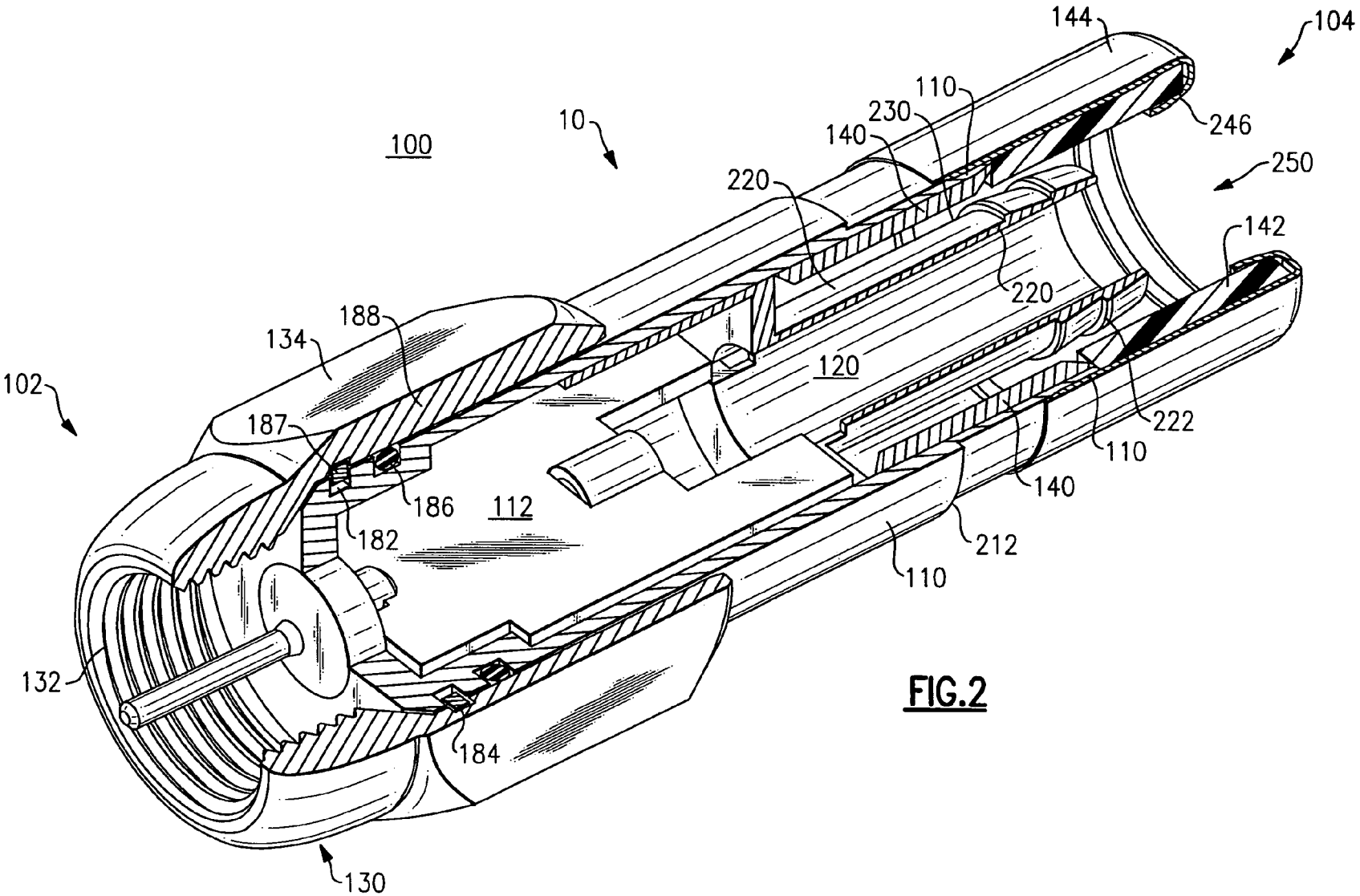
FIG. 2 is a cut-away perspective view of the assembled and uncompressed integrated filter connector of FIG. 1.

FIG. 2 is a cut-away perspective view of the assembled and uncompressed integrated filter connector 10 of FIG. 1. As depicted in FIG. 2, the nut 130 includes an interior groove 187 located along the interior surface of the nut 130. Likewise, the outer body 110 includes an exterior groove 182 located along the forward end of the exterior surface of the outer body 110. Both the interior groove 187 and the exterior groove 182 are configured to receive a nut retaining ring 184. The nut retaining ring 184 includes a gap to enable the ring 184 to be compressed (along its circumference) and fit into the exterior groove 182 prior to the nut 130 being slid over the front end of the outer body. The nut retaining ring 184 expands to snap engage the interior groove 187 of the nut 130, allowing the nut to rotate independently of the body 110.

A moisture sealing member 188 may be disposed inside of a second groove 186 located along the exterior surface of the outer body 110. The moisture sealing member 188 is preferably made of rubber and is configured to press upwards against the interior surface of the nut 130 in order to seal out moisture that could travel through the physical contact between the nut 130 and the outer body 110. In this embodiment the moisture sealing member is in the form of an O ring.

A set of compression related components, also referred to as a compression member assembly or a cable attachment mechanism, includes an insert sleeve 140, a compression member 142 and a compression member housing 144, also referred to as a housing member 144, and a throughbore co-located at an opening of an internal bore 250, and are disposed at the rear end 104 of the integrated filter connector 10. The compression member 142 is located at a rear end of the compression assembly. The insert sleeve is located at a forward end of the compression assembly.

The post 120 includes a front end and a rear end and is dimensioned to fit within an internal bore 250, also referred to as a central passageway 250 or a through bore 250, of the integrated filter connector 10. The central passageway 250 is defined by an internal surface 248. The front end and the rear end of the post 120 are disposed within the central passageway 250. The post 120 includes a sleeve 220, including a barbed portion 222 at a rear end of the post 120, for insertion beneath at least the braided wire mesh (outer conductor) of a coaxial cable (not shown) that can be inserted within the internal bore 250. As shown, the rear end of the post 120 optionally includes a plurality of barbs on the post serrations 222 to enable it to better mechanically and electrically engage the braided wire mesh (outer conductor) of the coaxial cable (not shown).

The compression member 142 may be surrounded by a housing member 144. A forward end of the housing member 144 includes a cylindrical sleeve that is dimensioned to fit and slide outside of and over a cylindrical shaped sleeve at the rear end of the outer body 110. As shown, the housing member 144 optionally includes an inward flange 246 at its rear end. The inward flange 246 radially surrounds at least a portion of an edge located at the rear end of the compression member 142.

As assembled, the compression member 142 is configured to abut the tapered rear end of the insert sleeve 140 while the housing member 144 is configured to slide over the rear end of the outer body 110 and surrounds the compression member 142 (See FIG. 2). The compression member 142 is dimensioned to fit inside of a cavity 230 residing between the insert sleeve 140 and the outer surface of the sleeve 220 of the post 120. The insert sleeve 140 is tapered at its rear end to enable the compression member 142 to slide into the insert sleeve 140 when an axial force (directed towards the forward end 102) is applied to advance the compression member 142 into the outer body 110.

As assembled, when axial force is applied to the housing member 144, the tapered rear end of the insert sleeve 140 slides between the compression member 142 and the housing member 144.

As described, the insert sleeve 140 is disposed around and outside of the post 120 and inside of the outer body 110. The compression member 142 is disposed abutting the insert sleeve 140, while the housing member 144 is disposed around and outside of the outer body 110.

To attach the integrated filter connector 10 to a coaxial cable, a prepared end of a coaxial cable is inserted into the internal bore 250 and engaged with the post 120 so that the sleeve 220 of the post is inserted beneath the outer layers of the coaxial cable (not shown), including at least the braided wire mesh (not shown) of an outer conductor. The central (center) conductor is received by the collet 116 at the rear end of the PCB 112.

The coaxial cable typically includes a central (center) conductor, a surrounding dielectric layer, and a surrounding electrically conductive material layer, such as referred to as a braided wire mesh outer conductor and an outer protective layer (cover), also referred to as a protective outer jacket. The outer layers of the coaxial cable refer to the outer conductor and an outer insulating layer.

The inward flange 246 is engaged with a compression tool (not shown) that applies the force to axially advance the housing member 144, also referred to as a compression member cover 144, and causes the compression member 142 to move (advance) towards the forward end 102 and further into the outer body 110.

Upon further axial advancement of the housing member 144 and of the compression member 142, the compression member 142 is driven between the inner sleeve 140 and the outer layers of the coaxial cable. This axial advancement causes an inward radial deformation of the compression member 142 against the outer layers of the cable (not shown) that surround the post 120.

This inward radial deformation compresses and firmly grasps the outer layers of the coaxial cable between the compression member 142 and the post 120 retaining the cable within the integrated filter connector. A shoulder 212 located on the exterior surface of the outer body 110 is configured to act as a stop to limit the axial advancement of the housing member 144 and the compression member 142 in the direction towards the forward end 102 of the outer body 110.

Figure 3:
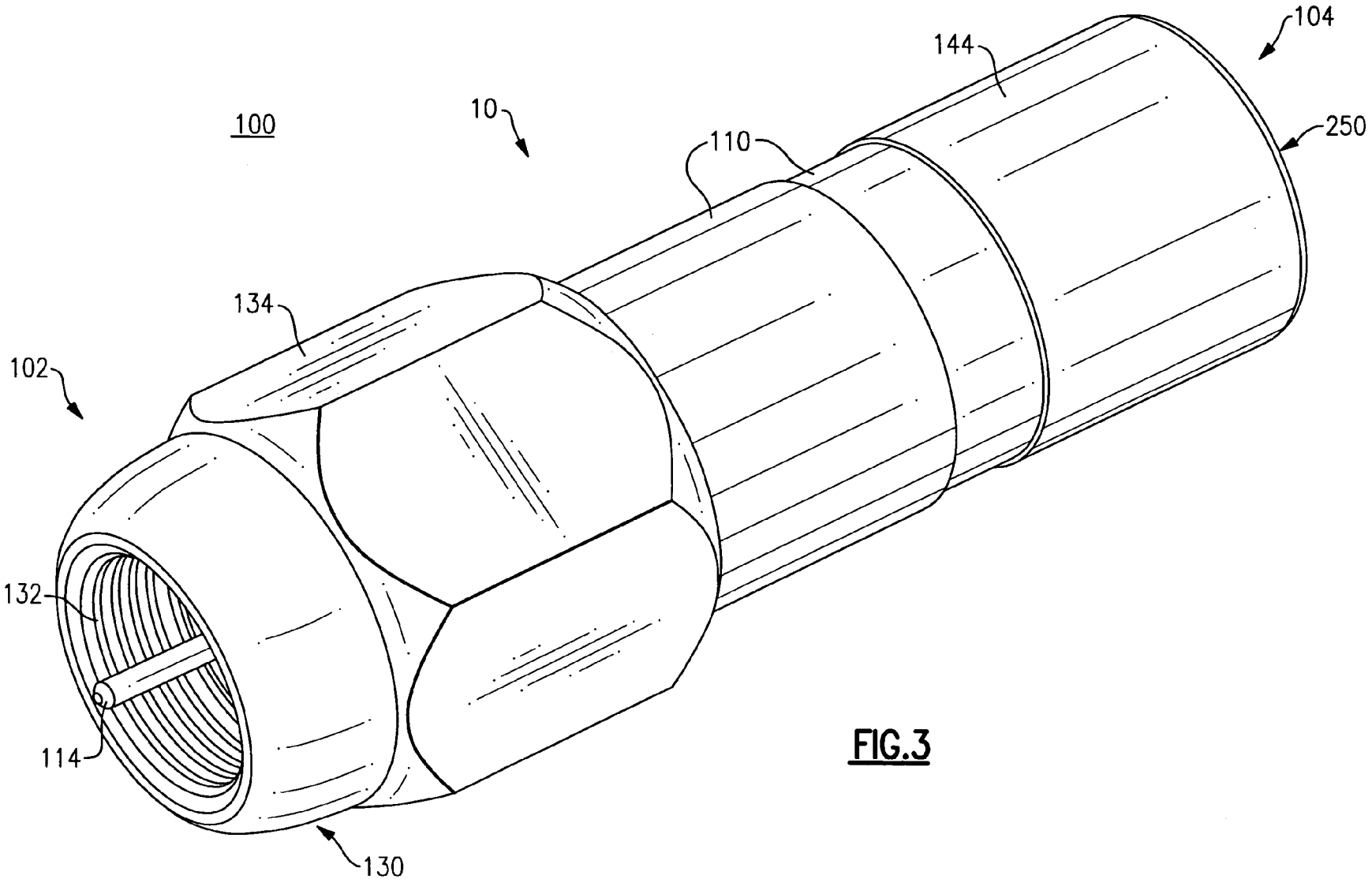
FIG. 3 is the assembled perspective view of the integrated filter connector of FIGS. 1 and 2.

FIG. 3 is a perspective view of the assembled and uncompressed integrated filter connector 10 of FIGS. 1 and 2. Notice that, as assembled, the contact pin 114 is substantially centered (eqi-distant) between the internal threads 132 of the nut 130.

Once installed on a cable, a tool may be used (not shown) to engage the flats 134 of the nut 130 and rotate the nut. The nut 130 can be rotated to selectively engage or disengage the integrated filter connector 10, to or from an externally threaded port (not shown), such as one included within a CATV distribution box.

Figure 4:
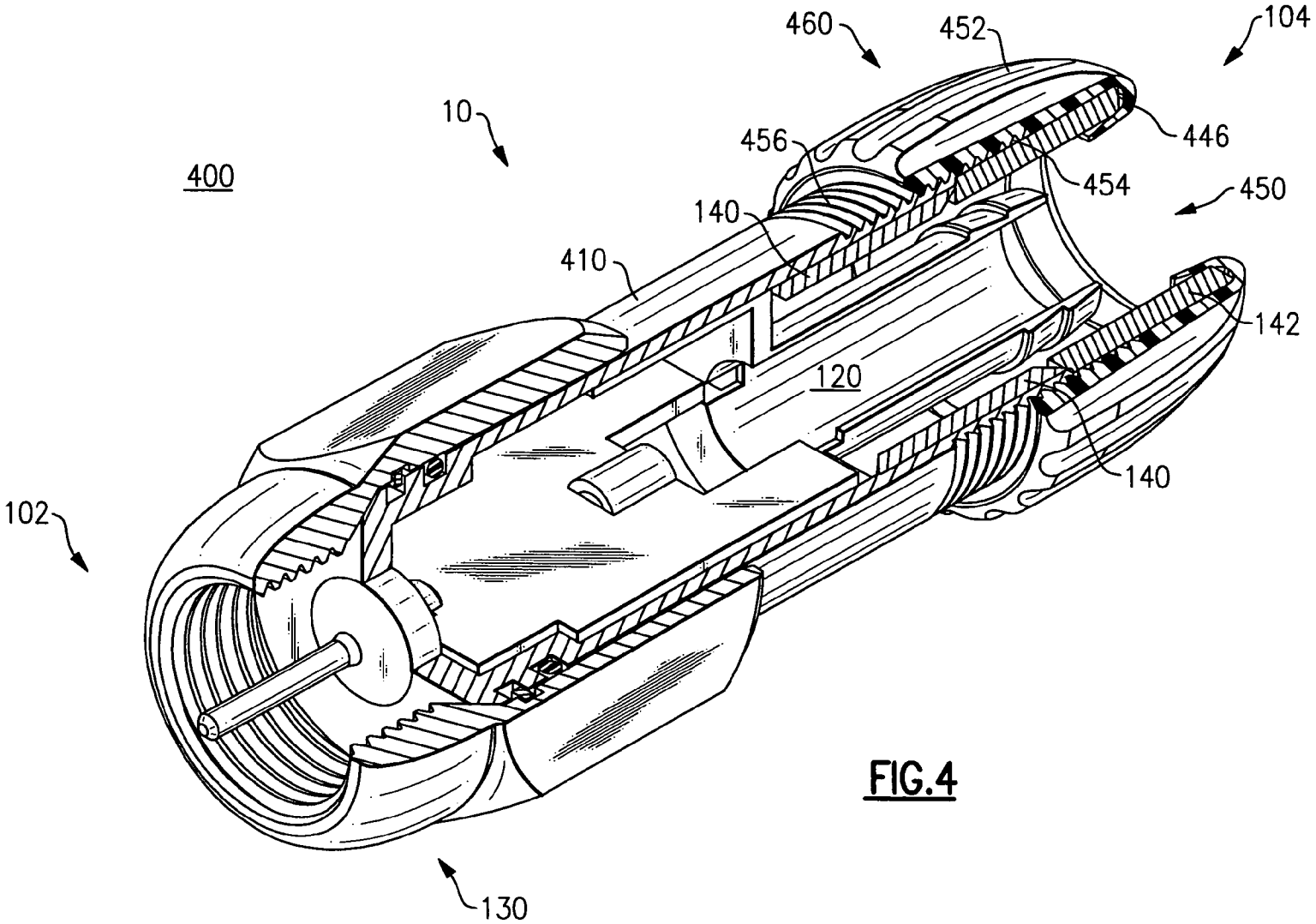
FIG. 4 is a cut-away perspective view of a second embodiment of an integrated filter connector including a hand rotatable compression component design.

FIG. 4 is a cut-away perspective view of a second embodiment 400 of an integrated filter connector 10 including a hand rotatable compression component design 460. The second embodiment 400 includes a structure that is substantially the same as described for the first embodiment 100 (See FIGS. 1-3) except for differences associated with a set of compression related components disposed at the rear end 104 of the integrated filter connector 10.

The outer body 410 is structured and functions in substantially the same way as the outer body 110 of the first embodiment 100 (See FIGS. 1-3). For example, the outer body 410 accommodates a rotatable nut 130 that is disposed at its front end 102 and provides substantially the same accommodation (shaped and dimensioned mechanical interface) for the aforementioned internal components that were described and provided by the outer body 110 of the first embodiment 100. The external surface of the outer body 410 excludes the shoulder 212 of the first embodiment 100 (See FIG. 2).

Further, the outer body 410 of the second embodiment 400 differs from the outer body 110 of the first embodiment 100 in that it accommodates a different compression component design 460 located at the rear end 104 of the outer body 410. Specifically, the external surface of the outer body 410 includes external threads 456 disposed at its rear end 104 that are configured to engage threads of an internal surface of the rotatable housing member 452, also disposed at its rear end.

Like the first embodiment 100, the compression component design 460 includes the inner sleeve 140 and the compression member 142 that are both disposed in substantially the same arrangement relative to the outer body 110 and its internal components, as described for the first embodiment 100 (See FIGS. 1-3). Unlike the first embodiment 100, the compression component design 460 of the second embodiment 400 excludes the sliding housing member 144 of the first embodiment 100 and instead, includes a rotatable housing member 452 at its rear end 104.

In this second embodiment, the compression member 142 is surrounded by the rotatable housing member 452. Like the sliding housing member 144, the rotatable housing member 452 includes an inward flange 446 at its rear end 104. The inward flange 446 radially surrounds at least a portion of the compression member 142.

A forward end of the rotatable housing member 452 includes an interior threaded surface 454 that is configured to engage an exterior threaded surface 456 disposed at the rear end 104 of the outer body 410. Rotation of the housing member 452 axially advances over the exterior threaded surface 456 and towards the front end 102 of the outer body 410.

Axial advancement of the rotatable housing member 452 towards the front end 102 advances the compression member 142 into the inner sleeve 140 to cause inward radial deformation of the compression member 142 against the outer layers of a coaxial cable that is inserted into the internal bore 450 and engaged with the post, as described for the first embodiment 100. The complementary threads 454 and 456 are configured to limit the axial advancement of the rotatable housing member 452. Complete advancement of the rotatable housing member 452 fully compresses the integrated filter connector 10 to compress and firmly grasp the outer layers of the coaxial cable.

Figure 5:
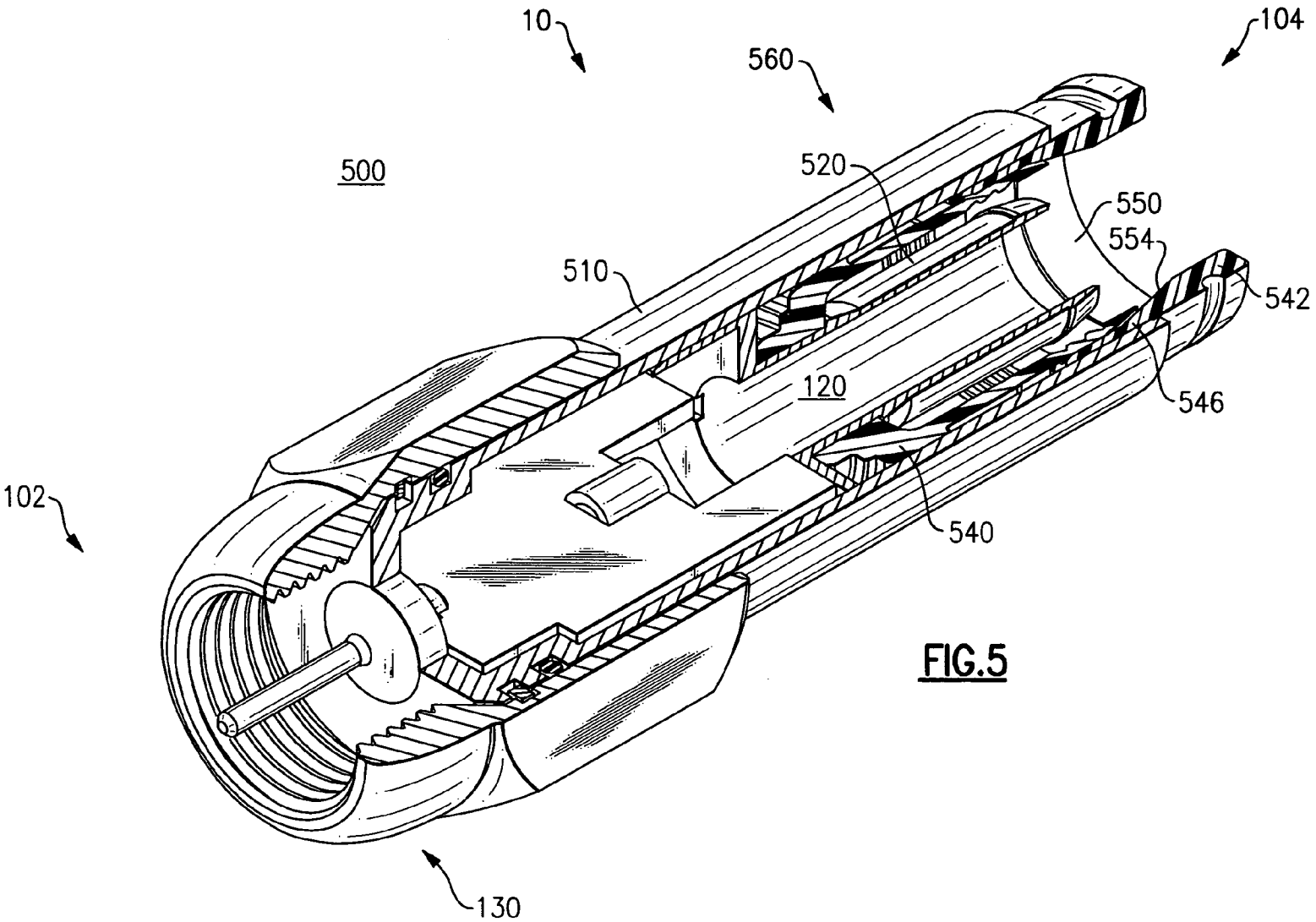
FIG. 5 is a cut-away perspective view of a third embodiment of an integrated filter connector including a different set of compression related components as compared to those of the prior two embodiments.

FIG. 5 is a cut-away perspective view of a third embodiment 500 of an integrated filter connector 10 including a different set of compression related components as compared to those of the prior two embodiments. The third embodiment 500 includes forward structures that are substantially the same as described for the first embodiment 100 except for differences associated with a set of compression related components 560 that are disposed towards the rear end 104 of the integrated filter connector 10.

The outer body 510 is structured and functions in substantially the same way as the outer body 110 of the first embodiment 100 (See FIGS. 1-3). For example, the outer body 510 accommodates a rotatable nut 130 that is disposed towards its front end 102 and provides substantially the same accommodation (shaped and dimensioned mechanical interface) for the aforementioned non-compression related internal components that were described in association with the outer body 110 of the first embodiment 100.

The outer body 510 of the third embodiment 500 differs from the outer body 110 of the first embodiment 100 in that it accommodates a different compression component design 560 located proximate its rear end 104. The external surface of the outer body 510 excludes the shoulder 212 of the first embodiment 100 (See FIG. 2) and excludes the threads 456 of the second embodiment 400 (See FIG. 4).

The non-compression related internal components of the fourth embodiment 500 are substantially the same as those described of the first embodiment 100. For example, the non-compression related internal components include the electrical circuit board 112 and its contact pin 114 and collet 116, the insulator 122 surrounding the contact pin 114, the post 120 and the circuit board support 118 and its slots 118*a* and 118*b* receiving the circuit board 112.

Like the first embodiment 100, the set of compression related components 560 includes an inner sleeve 540 and the compression member 542. Unlike the first embodiment, the set of compression related components 560 excludes the housing member 144, includes an inner sleeve 540 having serrations 546 that are configured to make physical contact with a coaxial cable (not shown). The third embodiment 500 also includes a compression member 542 that is configured to be inserted into the outer body 510, but over rather than into the inner sleeve 540. As with the previous embodiments, a prepared end of a coaxial cable is inserted into the central passageway 550 of the outer body 510. The central (center) conductor and dielectric layer are inserted into the sleeve 520 of the post. The braided wire mesh of the outer conductor and the outer protective layer of the cable occupy the annular space between the post 520 and the insert sleeve 546.

Axial advancement of the compression member 542 towards the front end of the outer body 510 causes the inner sleeve 540 to radially deflect inward towards the coaxial cable. In some embodiments, radial deflection of the inner sleeve 540 causes at least some crimping, meaning at least some non-elastic (plastic) deformation, to the coaxial cable. A tapered inner surface 544 of the compression member 542 causes inward radial deflection of the inner sleeve 540 towards the coaxial cable. Complete advancement of the compression member 542 fully compresses the integrated filter connector 10 to firmly grasp the outer layers of the coaxial cable and retain the cable within the integrated filter connector 10.

Figure 6:
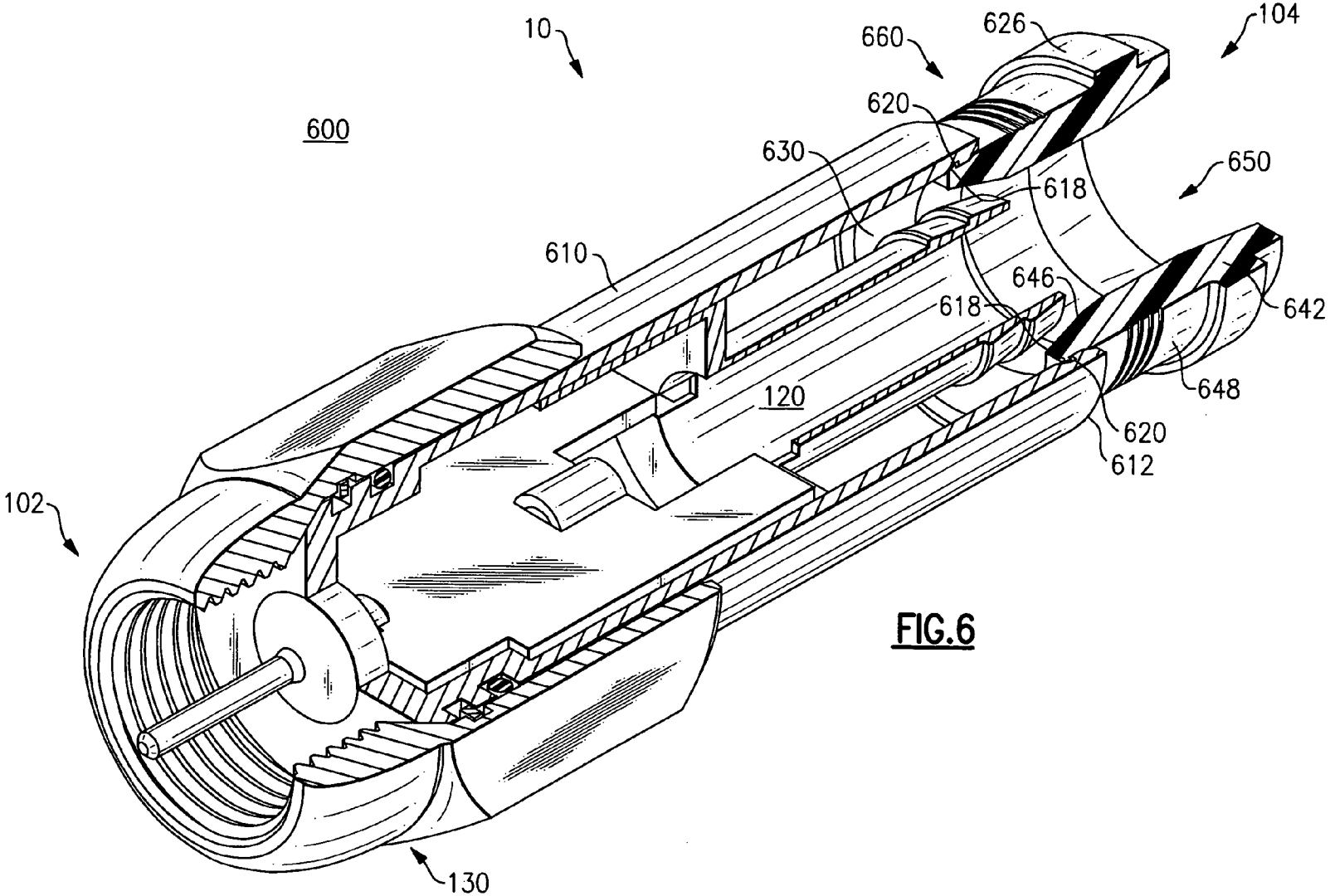
FIG. 6 is a cut-away perspective view of a fourth embodiment of an integrated filter connector including a different set of compression related components as compared to those of the prior three described embodiments.

FIG. 6 is a cut-away perspective view of a fourth embodiment 600 of an integrated filter connector 10 including a different set of compression related components 660 as compared to those of the previously described embodiments. The fourth embodiment 600 includes forward structures that are substantially the same as described for the first embodiment 100 except for differences associated with a set of compression related components 660 that are disposed proximate to the rear end 104 of the integrated filter connector 10.

The outer body 610 is structured and functions in substantially the same way as the outer body 110 of the first embodiment 100 (See FIGS. 1-3). For example, the outer body 610 accommodates a rotatable nut 130 that is disposed towards its front end 102 and provides substantially the same accommodation (shaped and dimensioned mechanical interface) for the aforementioned non-compression related internal components that were described in association with the outer body 110 of the first embodiment 100.

The outer body 610 of the fourth embodiment 600 differs from the outer body 110 of the first embodiment 100 in that it accommodates a different compression component design 660 located proximate its rear end 104 and that it excludes the shoulder 212 of the first embodiment 100. Also, outer body 610 excludes the external threaded surface 456 of the second embodiment 400 (See FIG. 4).

The non-compression related internal components of the fourth embodiment 600 are substantially the same as those described of the first embodiment 100. For example, the non-compression related internal components include the circuit board 112 and its contact pin 114 and collet 116, the insulator 122 surrounding the contact pin 114, the post 120 and the circuit board support 118 and its slots 118*a* and 118*b* receiving the circuit board 112.

The set of compression related components of the fourth embodiment includes a compression member 642 that is shaped differently than the compression member 142 of the first embodiment 100 (see FIGS. 1-2) and the set excludes the inner sleeve 140 and the housing member 144 (See FIGS. 1-2) of the first embodiment.

As shown, the compression member 642 has an interior surface which includes a tapered portion 646. The tapered inner surface has a substantially conical profile. An external surface of the compression member 642 optionally includes a flange 626 and a protruding ridge 618, also referred to as a rib 618. The rib 618 is configured to mate and slidingly engage with an internal groove 620 cut into an inner surface near the rear end of the outer body 610. The groove 620 is configured to retain the compression member 642 in a first, uncompressed position, as shown.

In the first, uncompressed position, a properly prepared end of a coaxial cable (not shown) may be inserted into an internal bore 650 through the compression member 642 to engage the post 120. As shown, the rib 618 is optionally configured to assist in the axially advancement of the compression member 642 further into the outer body 610 towards the forward end 102. The rib 618 may optionally be configured with an inclined forward face to assist with axial advancement of the compression member 642 further into the outer body 610. The rib 618 may also include a rear face that may be either perpendicular to the external surface 648 of the compression member or inclined to inhibit or promote, respectively, the removal of the compression member 642 from the outer body 610, as desired.

As shown, the location of the flange 626 and the rear edge 612 of the outer body 610 are configured to act as a barrier (stopping mechanism) to limit the forward axial advancement of the compression member 642. The rear end 104 of the compression member 642 includes an external flange 626 of greater diameter than that of an inner diameter of the rear end of the outer body 610. Axial advancement of the compression member 642 is stopped when the flange 626 makes physical contact with the rear edge 612 of the outer body 610.

An external surface 648 of the compression member 642 that is located in the forward direction relative to the flange 626 has an external diameter substantially the same as or slightly greater than the inner diameter of the outer body 610 to create a press fit effect of the compression member 642 into the outer body 610. The press fit effect inhibits the inadvertent removal of the compression member 642 after its compression (installation) into the outer body 610.

Alternatively, the external surface 648 of the compression member 642 may include a second rib (not shown) which engages the groove 620 located on the internal surface near the rear end of the outer body 610 to create an interference fit, also referred to as a snap engagement, between the compression member 642 and the outer body 610 during installation of a coaxial cable (not shown) via axial advancement (compression) of the compression member 642 into the outer body 610.

Upon axial advancement of the compression member 642 into the outer body 610, the compression member 642 is driven into a cavity 630 located between the inner surface of the outer body 610 and the outer layers of the coaxial cable, that include at least the braided wire mesh and protective outer layers (not shown). The compression member 642 is dimensioned to fit inside of the cavity 630 and the axial advancement of the compression member 642 reduces the volume of the cavity 630 and compresses and firmly grasps the outer layers of the cable between the compression member and the post, retaining the cable within the integrated filter connector 10.

Figure 7:
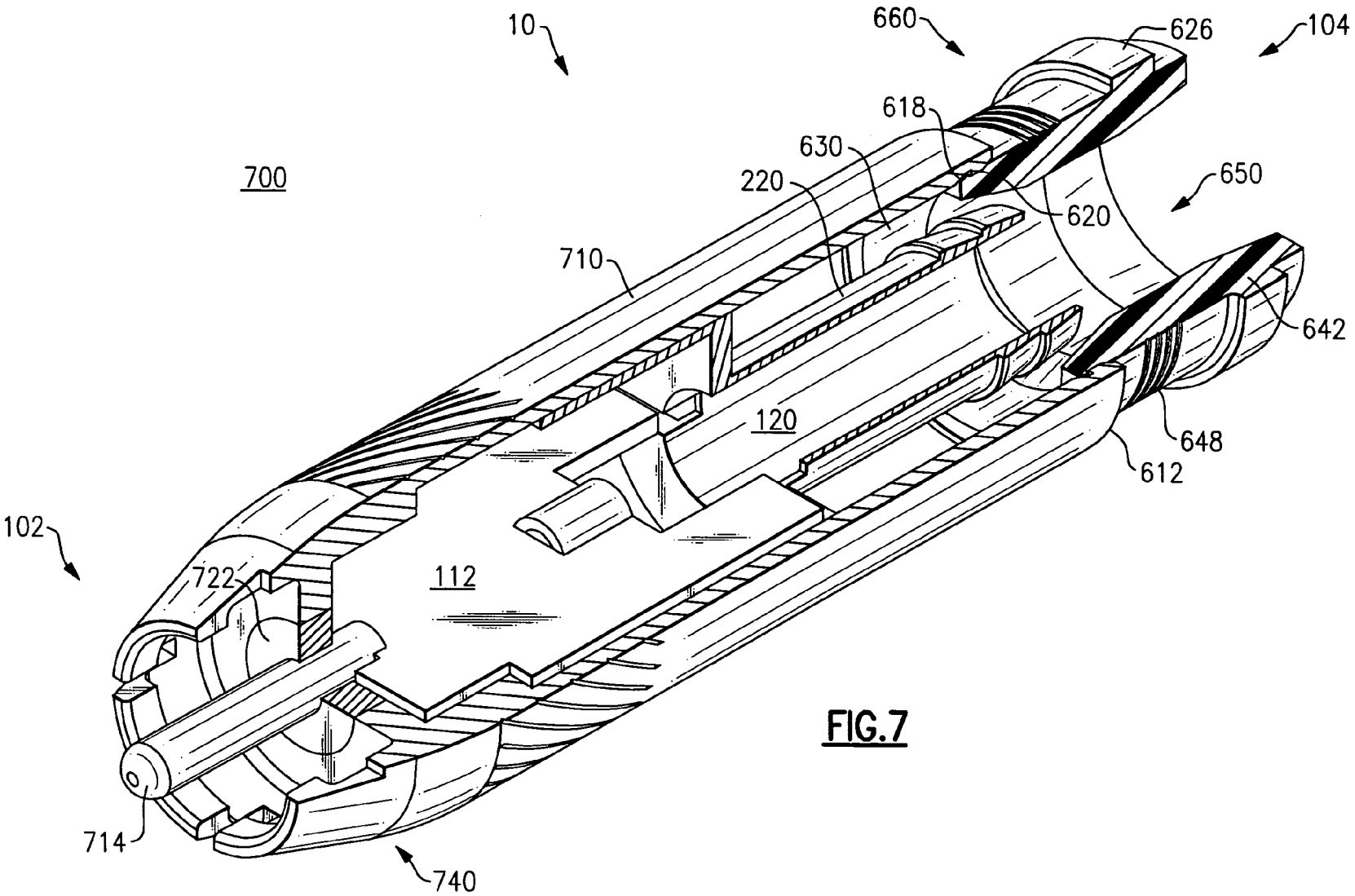
FIG. 7 is a cut-away perspective view of an integrated filter connector in accordance with a fifth embodiment of the present invention including an RCA style connector interface.

FIG. 7 is a cut-away perspective view of an integrated filter connector 10 in accordance with a fifth embodiment 700 of the present invention including an RCA style connector interface. An RCA style connector interface includes a male and a female connector that do not include threads and that are not required to be rotated to be engaged with each other. RCA style connectors are simply pushed together to be engaged and pulled apart to be disengaged. Hence, a nut 130 is not required and is excluded from the fifth embodiment 700 of the integrated filter connector 10.

The fifth embodiment 700 is structured in the same manner with respect to the compression related components of the fourth embodiment 600 and with respect to many of the non-compression related internal components of the fourth embodiment 600 (See FIG. 6). The non-compression related internal components include the circuit board 112 and its collet 116, the post 120 and its attached circuit board support 118 and its slots 118*a* and 118*b* receiving the circuit board 112. The contact pin 714 and the insulator 722 surrounding the contact pin 714 are configured to support the structure of an RCA style male connector 740 and may be different that those for previous described embodiments.

The outer body 710 is structured and functions in substantially the same way, as the outer body 610 of the fourth embodiment 600 of the integrated filter connector 10. Accordingly, the outer body 710 provides substantially the same mechanical support (accommodation) for the aforementioned compression and non-compression related components that were provided by the outer body 610 of the fourth embodiment.

The outer body 710 of the fifth embodiment 700 differs from the outer body 110 of the first embodiment 100 in that it does not accommodate a nut 130 (See FIGS. 1-3) at its forward end 102. Instead of the nut 130, a male RCA connector 740 is disposed at the forward end 102 of this fifth embodiment 700 of the integrated filter connector 10. The contact pin 714 is configured to constitute a "stinger" portion of the male RCA connector.

Figure 8:
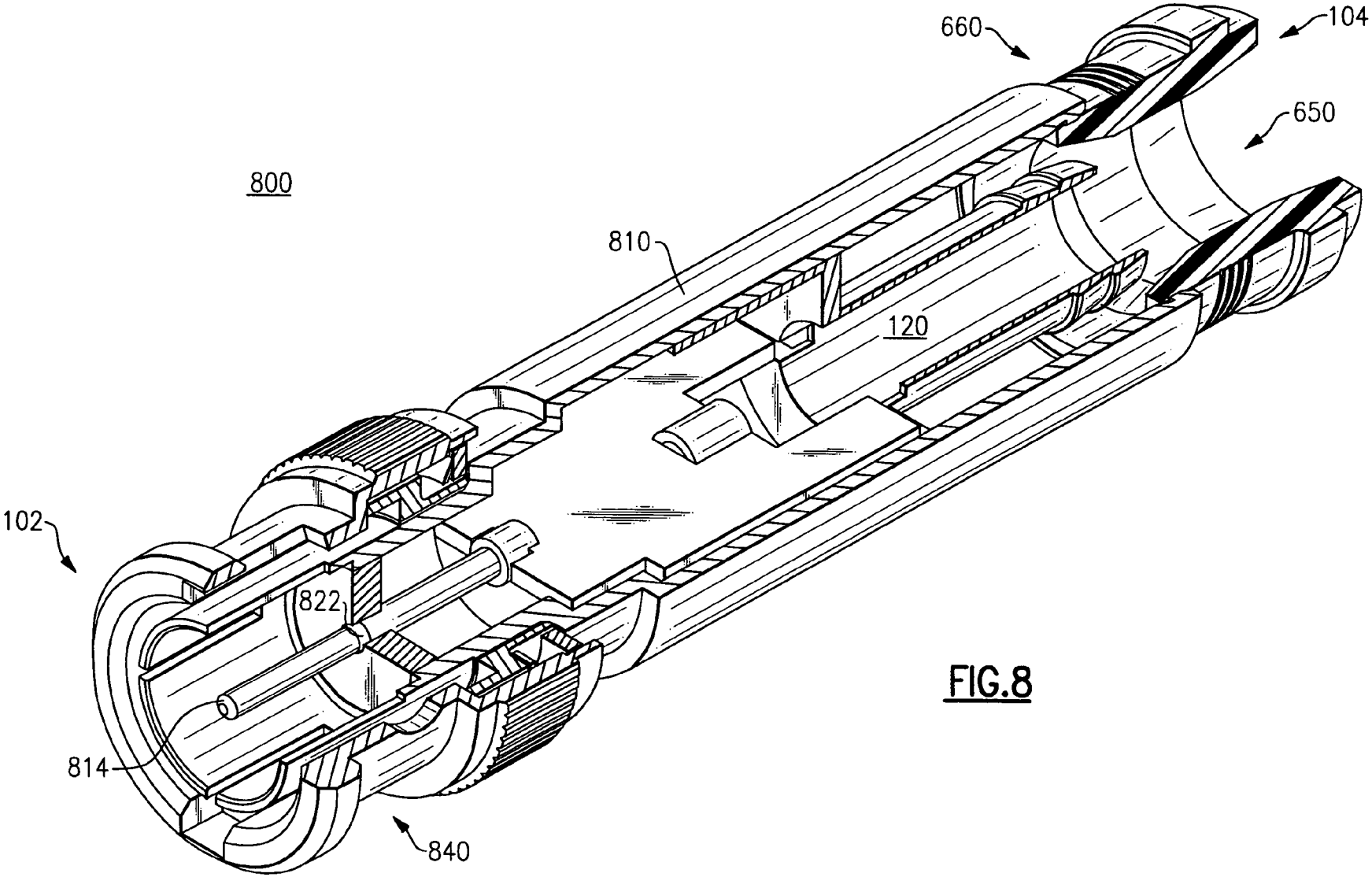
FIG. 8 is a cut-away perspective view of a sixth embodiment of the integrated filter connector that includes a BNC style connector interface.

FIG. 8 is a cut-away perspective view of a sixth embodiment 800 of the integrated filter connector 10 that includes a BNC style connector interface. In this embodiment, a BNC style connector interface substitutes for the RCA style interface of the fifth embodiment 700. A BNC style connector interface includes a male and a female connector that do not include threads like that of the nut 130 of the first embodiment 100 (See FIGS. 1-3). BNC style connectors are pushed towards each other and twisted less than one full 360 degree turn to be engaged and disengaged.

The sixth embodiment 800 is structured and functions substantially as the fifth embodiment 700 of the integrated filter connector 10 of FIG. 7 except that a BNC style male connector 840 is substituted for the RCA style male connector 740 (Shown in FIG. 7). The outer body 810 of the sixth embodiment 800 differs from the outer body 710 of the fifth embodiment 700 in that it accommodates a male BNC connector 840 instead of a male RCA connector 740 disposed at the forward end 102. The contact pin 814 and its insulator 822 are configured to constitute a "stinger" portion of the male BNC connector. Other aspects of the sixth embodiment 800, including the compression component design, are the same as that of the fifth embodiment 700 of FIG. 7.

Figure 9:
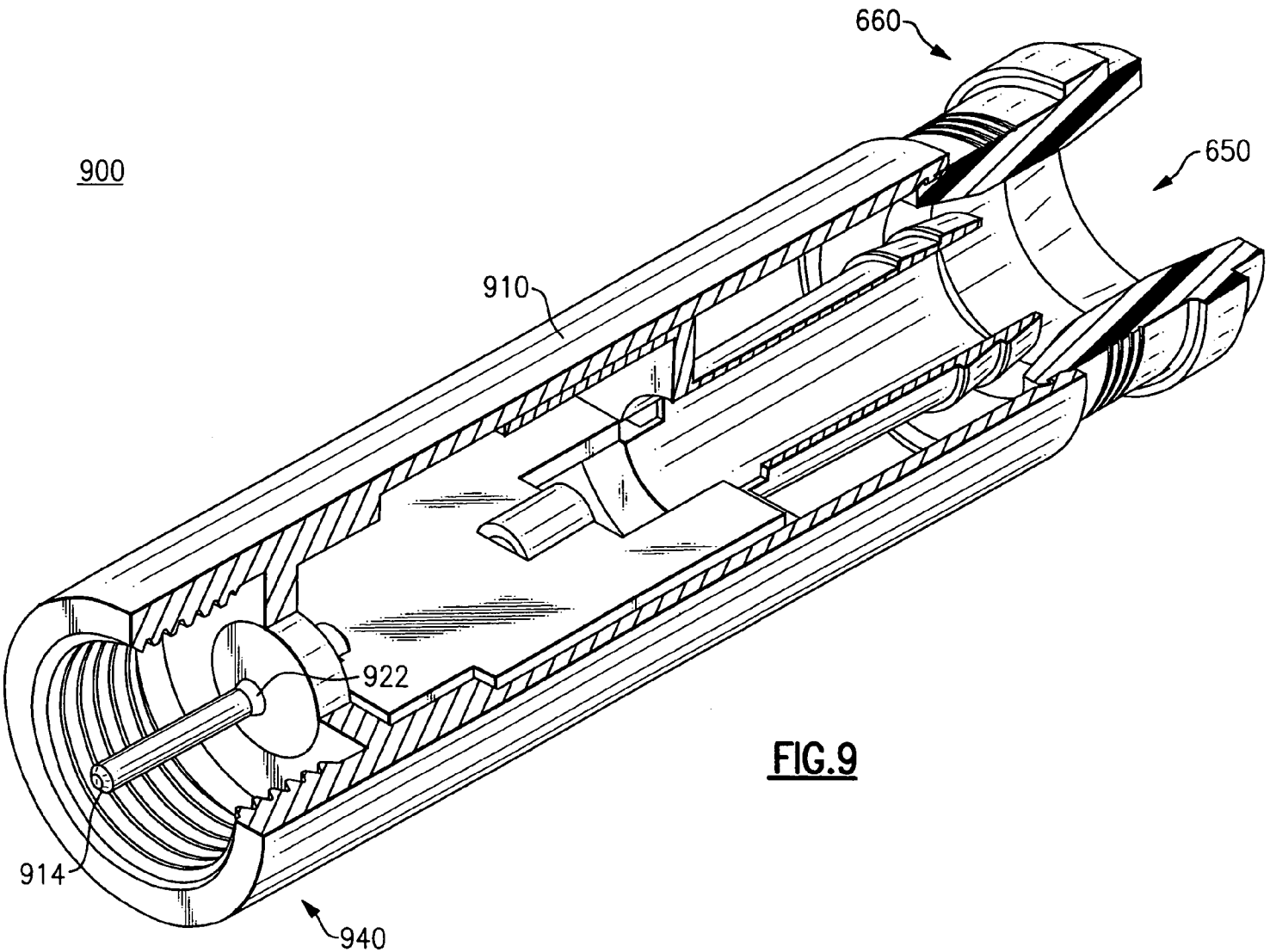
FIG. 9 is a cut-away perspective view of a seventh embodiment of the integrated filter connector that includes an F style male connector interface.

FIG. 9 is a cut-away perspective view of a seventh embodiment 900 of the integrated filter connector 10 that includes an F style male connector interface. In this embodiment, an F style male connector interface substitutes for the RCA style connector 740 interface of the fifth embodiment 700. An F style connector interface includes a male and a female connector that include threads like that of the nut 130 of the first embodiment 100 (see FIGS. 1-3). The F style connectors are engaged and rotated in a clockwise direction to be engaged and are rotated in a counter clockwise direction to be disengaged.

The seventh embodiment 900 is structured in the same manner as the fifth embodiment 700 of the integrated filter connector 10 of FIG. 7 except that an F style male connector 940 is substituted for the RCA style male connector 740 (Shown in FIG. 7). Other aspects of the seventh embodiment, including the compression component design, are the same as that of the fifth embodiment 700 of FIG. 7.

Figure 10:
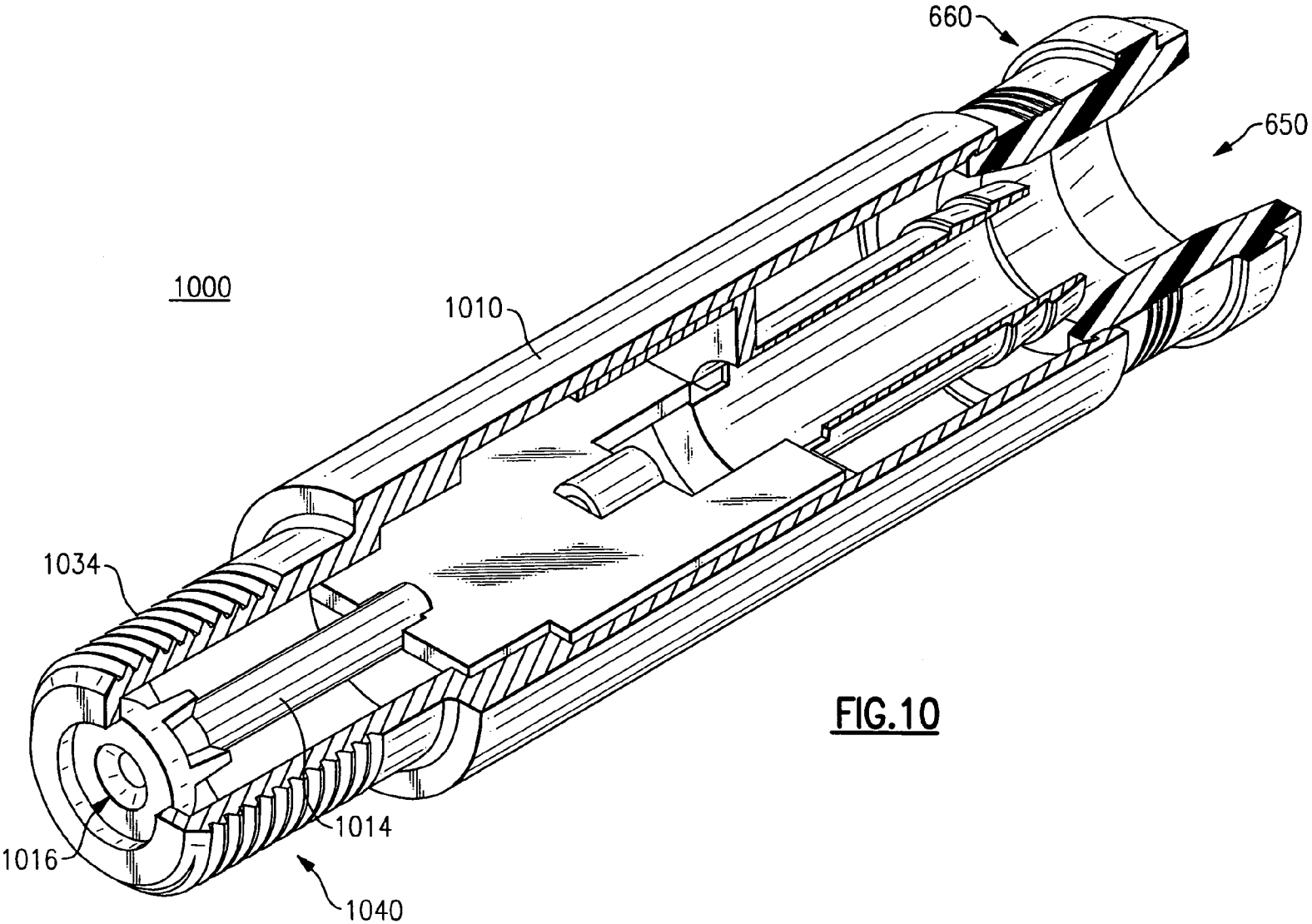
FIG. 10 is a cut-away perspective view of an eighth embodiment of the integrated filter connector that includes an F style female connector interface.

FIG. 10 is a cut-away perspective view of an eighth embodiment 1000 of the integrated filter connector 10 that includes an F style female connector interface. In this embodiment, an F style female connector 1040 interface substitutes for the RCA style male connector 740 interface of the fifth embodiment 700 of FIG. 7. An F style connector 1040 interface includes a male and a female connector that each include threads like that of the nut 130 of the first embodiment 100 (see FIGS. 1-3). The F style connectors are engaged and rotated in a clockwise direction to be engaged and are rotated in a counter clockwise direction to be disengaged.

The eighth embodiment 1000 is structured in the same manner as the fifth embodiment 700 of the integrated filter connector 10 of FIG. 7 except that an F style female connector 1040 is substituted for the RCA style male connector 740 (Shown in FIG. 7). Instead of contact pin 714, as shown in the fifth embodiment 700, a collet 1014 is disposed proximate to the front end 102 of the integrated filter connector 10. An insulator cap 1016 is disposed between the collet 1014 and the F-style female connector 1040. As shown, the collet 1014 is surrounded by external threads 1034. Other aspects of the eighth embodiment 1000, including the set of compression related components, are the same as that of the fifth embodiment 700 of FIG. 7.

Figure 11:
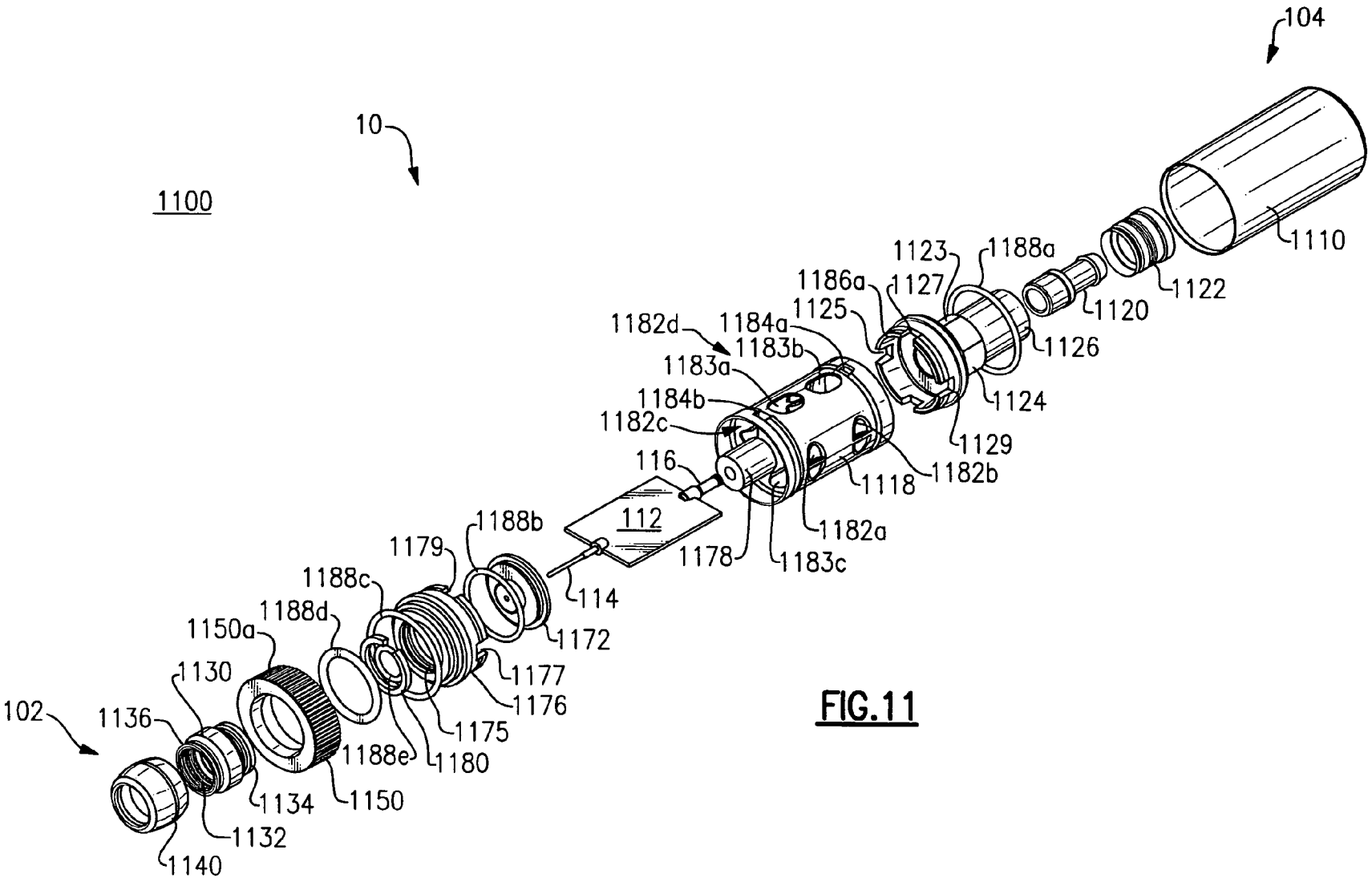
FIG. 11 is an exploded perspective view of a ninth embodiment of an unassembled integrated filter connector made in accordance with the present invention.
Figure 12:
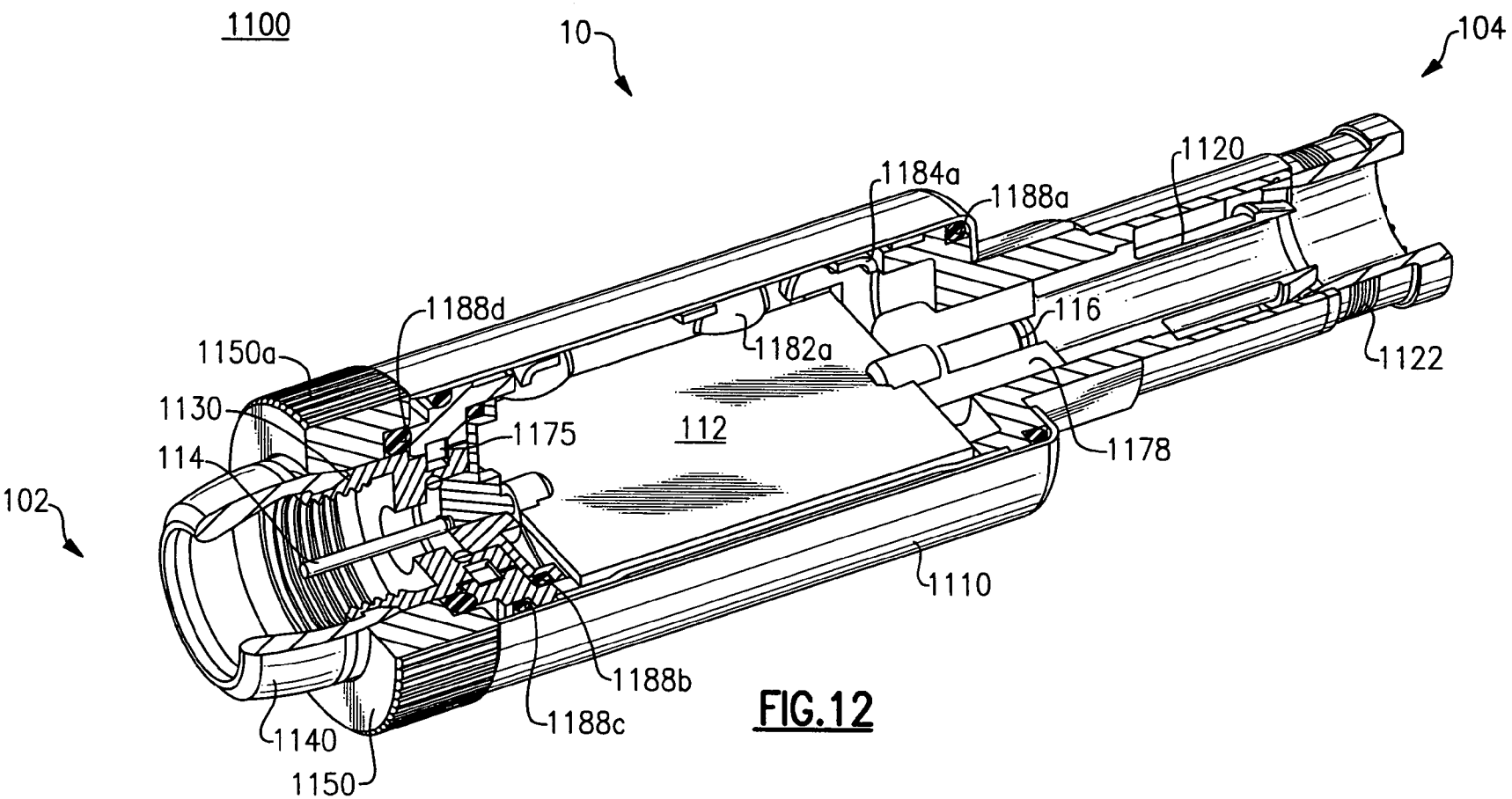
FIG. 12 is a cut-away perspective view of the assembled and uncompressed integrated filter connector of FIG. 11.
Figure 13:
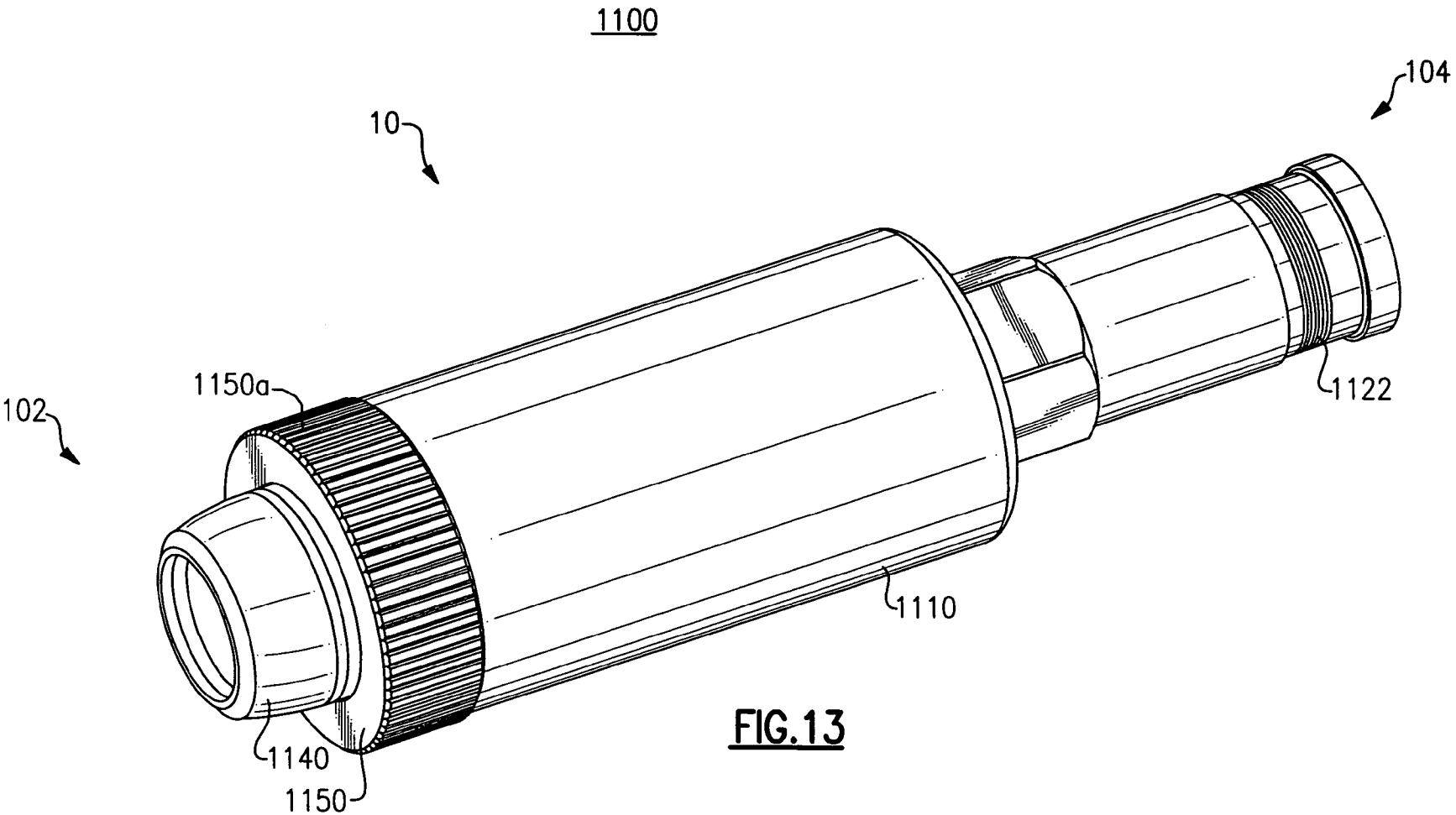
FIG. 13 is a perspective view of the assembled and uncompressed integrated filter connector of FIGS. 11 and 12.

FIG. 11 is an exploded perspective view of a ninth embodiment 1100 of an unassembled integrated filter connector 10 made in accordance with the present invention. FIG. 12 is a cut-away perspective view of the assembled and uncompressed integrated filter connector 10 of FIG. 11. FIG. 13 is a perspective view of the assembled and uncompressed integrated filter connector 10 of FIGS. 11 and 12.

As shown, the integrated filter connector 10 includes a forward end 102 and a rear end 104, an outer body 1110 and an inner body 1118, which is configured to enclose a printed circuit board (PCB) 112 that performs in-line signal conditioning and that functions as part of an integrated signal filter assembly. The forward end 102 of the inner body 1118 is capped by a forward header 1176 and the rear end 104 of the inner body 1118 is capped by a rear header 1124. The inner body 1118 and outer body 110 are each also referred to as a cylindrical housing.

The circuit board 112 includes a forward electrode 114 and a rear electrode 116. Typically, the forward electrode is implemented as a contact pin 114 and the rear electrode is implemented as a collet 116. In some embodiments, the forward electrode is also implemented as a collet 116. The PCB 112 also includes a ground plane (not shown) and a forward electrical contact pad (not shown) and a rear electrical contact pad (not shown) at each of two opposite ends.

The forward electrical contact pad is in electrical contact with the forward electrode 114. The rear electrical contact pad is in electrical contact with the rear electrode 116. A forward insulator 1172 is configured to surround and electrically isolate the forward contact pin 114 from the cylindrical inner body 1118 and the forward header 1176. A rear insulator 1178 is configured to surround and electrically isolate the rear contact pin 116 from the rear header 1124. As shown, the forward insulator 1172 is shaped as a disk and the rear insulator 1178 is shaped as a cylindrical sleeve. The insulators are typically made of an insulating material such as silicone rubber or non-conductive plastic.

The cylindrical inner body 1118 that is also referred to herein as a circuit board support 1118, is configured to receive and to provide mechanical support to the circuit board 112. In this embodiment, the circuit board support 1118 is constructed as a cylindrical shaped tubular member and includes at least two opposing inwardly deflected tabs 1182*a*-1182*d*, also referred to as inward tabs 1182*a*-1182*d*, the ends of which form circuit board supporting slots. The inward tabs 1182*a*-1182*d* are disposed at locations along an outer surface of the cylindrical inner body member 1118 and are oriented and dimensioned to receive and to provide mechanical support to the circuit board 112. While in the current embodiment, the circuit board supporting slots formed by the inward tabs are aligned with the longitudinal axis of the inner cylindrical body member 1118, the tabs could be positioned to support the PCB 112 off-set from the longitudinal axis. Moreover, while the circuit board 112 is shown oriented with the longitudinal axis of the cylindrical inner body 1118, the board may also be disk shaped and oriented perpendicular to the longitudinal axis. In such an alternative embodiment, the contact pins and collet would connect to each face of the PCB 112 rather than opposing ends.

The cylindrical inner body 1118 may also be configured with at least one access hole or passageway 1183*a*-1183*c* to permit the tuning of filter components after the PCB 112 is inserted into cylindrical inner body 1118. Where such tunable filter components are mounted on both sides of the circuit board, the access 1183*a*-1183*c* holes may be located at several locations around the exterior surface of the cylindrical inner body 1118.

The cylindrical inner body 1118 may also be configured with end tabs 1184*a* and 1184*b*. The end tabs are provided to mate with corresponding slots 1179, 1177 on the forward header 176 and the rear header 1124 and provide the function of rotationally locking the headers to the inner body 1118 such that rotation of the header does not exert substantial torque upon the printed circuit board 112 that could damage the circuitry thereon and the effectiveness of the signal filter assembly.

The forward end of the cylindrical inner body 1118 is capped by a forward header 1176. The forward header may be configured to include opposing longitudinal slots 1177, 1179 which are positioned to receive and support the forward corners of the PCB 112. The rear end of the forward header 1176 may also be configured to receive the forward insulator 1172. Either or both the forward header and the forward insulator may include a shoulder or groove to seat an O-ring 1188*b* to form a seal between these adjacent components. The forward header 1176 has an inner surface defining a central throughbore. The inner surface includes an internal groove 1175 for the partial seating of the locking snap ring 1180.

The central throughbore of the forward header 1176 receives a nut 1130 having an inner surface, an outer surface, forward and rear ends. The inner surface at the forward end of the nut 1130 includes internal threads for mating with a threaded port or other fixture having corresponding external threads. The external surface of the rear end of the nut 1130 includes a groove 1134 for partially receiving the locking snap ring 1180. With the snap ring 1180 partially seated in both grooves 1175 and 1134, the nut 1130 is engaged with the forward header 1176, but rotates independently thereof.

A grip ring 1150 is press fit over a portion of the external surface of the nut 1130. The press fit is sufficiently tight such that rotation of the grip ring 1150 causes rotation of the nut 1130. As shown, the grip ring 1150 has a knurled outer surface 1150*a* that enables a person to hand tighten the attachment (coupling) of the filter connector to a port, such as to a CATV port or to another coaxial cable connector.

The integrated filter connector 10 may also include a port seal 1140 which is attached to the forward end of the nut 1130 to prevent the ingress of moisture along the threaded port and between the nut 1130 and the grip ring 1150. In the present embodiment, the port seal 1140 is a bellows-type seal of the nature and general description contained in co-pending U.S. patent application Ser. No. 10/876,386, filed Jun. 25, 2004, which is incorporated herein by reference. Alternatively, as is well-known in the art, the port seal 1140 may be configured as a tubular grommet comprised of silicone rubber and having interlocking shoulders or steps, such as described in U.S. Pat. No. 4,869,679 issued on Sep. 26, 1989. The nut 1130 may also be configured to grasp and retain the port seal 1140. In the present embodiment, the nut 1130 has a seal grasping surface which includes an external groove 1136 on the forward end of the nut 1130. The port seal 1140 may also be configured with an internal shoulder at the rear end of the port seal that engages the forward side wall of the groove 1136. The grip ring 1150 may also be configured to engage the rear portion of the port seal 1140. The engagement of the port seal assists in both retaining the port seal as an integral part of the assembly 10 and in forming a seal to prevent the infiltration of moisture between the nut 1130 and the grip ring 1150.

Sealing members may be disposed between the components at the forward end of the integrated filter connector 10 to seal any potential paths for moisture infiltration. Shoulders, grooves or annular spaces are formed in the respective components to properly seat the sealing members. As depicted in FIGS. 11 and 12, four sealing members in the form of O-rings 1188*b*-1188*e* are disposed at the forward end of the assembly. Sealing member 1188*b* is disposed between the forward insulator 1172 and the rear end of the forward header 1176. Sealing member 1188*c* is disposed between the forward end of the forward header 1176 and the outer body 1110. Sealing member 1188*d* is disposed between the forward end of the forward header and the grip ring 1150. Sealing member 1188*e* is disposed between forward end of the forward insulator and the nut 1130.

The rear end of the cylindrical inner body 1118 is capped by the rear header 1124. The rear header 1124 is both press fit into the opening at the rear end of the inner body 1118 and rotationally locked by engagement of an end tab 1184*a* in a corresponding longitudinal slot 1127 at the forward end of the rear header 1124. Opposing longitudinal slots 1125, 1127 are positioned to receive and support the rear corners of the circuit board 112. The ground plane of the circuit board 112 may be electrically engaged by either the longitudinal slots formed by the tabs 1182*a-d* or the longitudinal slots 1177, 1179 in the forward 1176 or rear 1124 headers.

The rear header 1124 has an inner surface defining a central throughbore. The rear header 1124 may also include an external shoulder or groove (not shown) to seat an O-ring 1188*a* which forms a seal between the rear header 1124 and the outer body upon final assembly. Outer body 1110 is slid over the assembled inner body 1118 and headers. A press fit is formed between the outer body 1110 and circular flanges on each of the forward 1176 and rear 1124 headers. The rear end of the outer body 1110 is rolled over to seat the first O-ring 1188*a* and seal the rear end of the assembly from moisture.

The inner surface of the rear header 1124 includes an internal groove (not shown) for the partial seating of the locking member 1122. The inner surface of the rear header 1124 may also be configured to receive the rear insulator 1178. The inner surface of the rear header 1124 is also configured to receive a post 1120 which, in this embodiment includes a step or taper in the internal bore which mates with a corresponding shoulder or tapered surface on the post. The rear portion of the post generally includes a sleeve which is adapted to be inserted over the dielectric layer of the cable and electrically engage the outer conductor of the coaxial cable (not shown). Engagement of the outer conductor and retention of the integrated filter connector 10 on the coaxial cable may be assisted by the inclusion of a barb or other serrations on the post sleeve.

A locking member 1122 is dimensioned and configured to be inserted into the central throughbore of the rear header 1124. The locking member 1122 may include one or more protruding ridges that engage a corresponding groove (not shown) on the inner surface of the slide into the rear header component 1124. The locking member 1122 is snap-engaged in a first position partially inserted into the rear end of the rear header 1124 such that a properly prepared end of a coaxial cable may be inserted into the rear header 1124 in a manner similar to co-owned U.S. Pat. No. 5,470,257 which is incorporated by reference herein. When fully inserted, the central (center) conductor of the coaxial cable engages the collet 116 attached to the rear contact pad at the rear of the PCB 112; the dielectric layer is inserted within the post 1120; the outer conductor and protective outer jacket of the coaxial cable are disposed within the annular space between the post sleeve and the inner surface of the rear header 1124.

After insertion of the cable, the locking member 1122 is axially advanced further into the rear end of the rear header 1124 until the end of the rear header 1124 abuts an exterior flange at the rear end of the locking member 1122. In this embodiment, the locking member 1122 will be press fit into the rear end of the rear header 1124. Alternatively, a second protruding shoulder could be formed on the exterior of the locking member 1122 that snap engages the locking member 1122 into a second compressed position, or a second internal groove (not shown) on the inner surface of the rear header 1124 into which the protruding ridge is engaged in such second compressed position. The outer surface of the rear header 1124 may include hexagonal flats 1123 for engagement by a tool, such as a box wrench, to assist in the rotation of the assembly. Upon advancement, a tapered inner surface of the locking member 1122 reduces the internal volume of the annular space within the rear header 1124. The inner surface of the locking member 1122 grasps the outer layers of the coaxial cable against the post sleeve to retain the cable within the rear header 1124 of the integrated filter connector 10.

Figure 14:
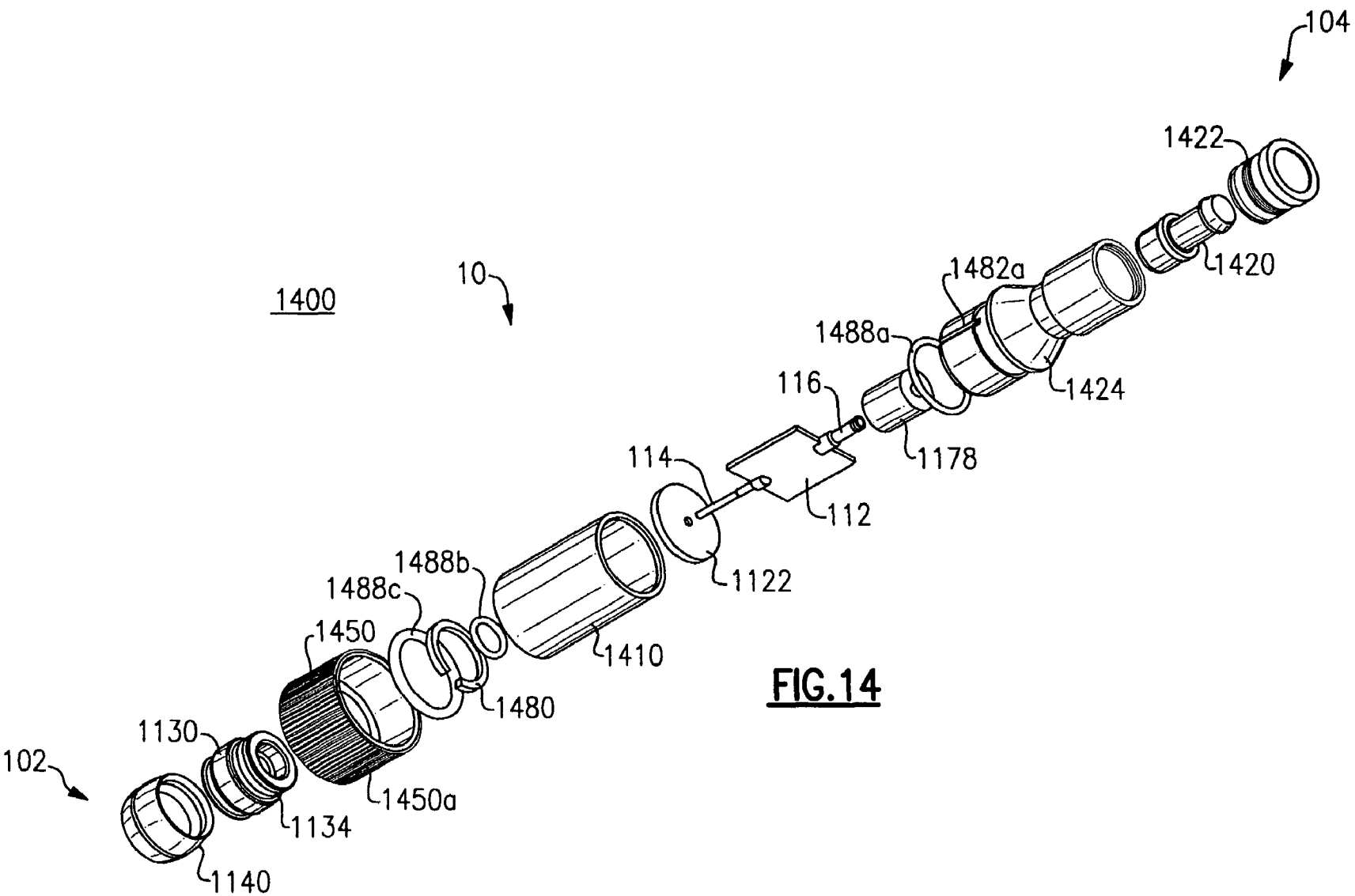
FIG. 14 is an exploded perspective view of a tenth embodiment of an unassembled integrated filter connector made in accordance with the present invention.
Figure 15:
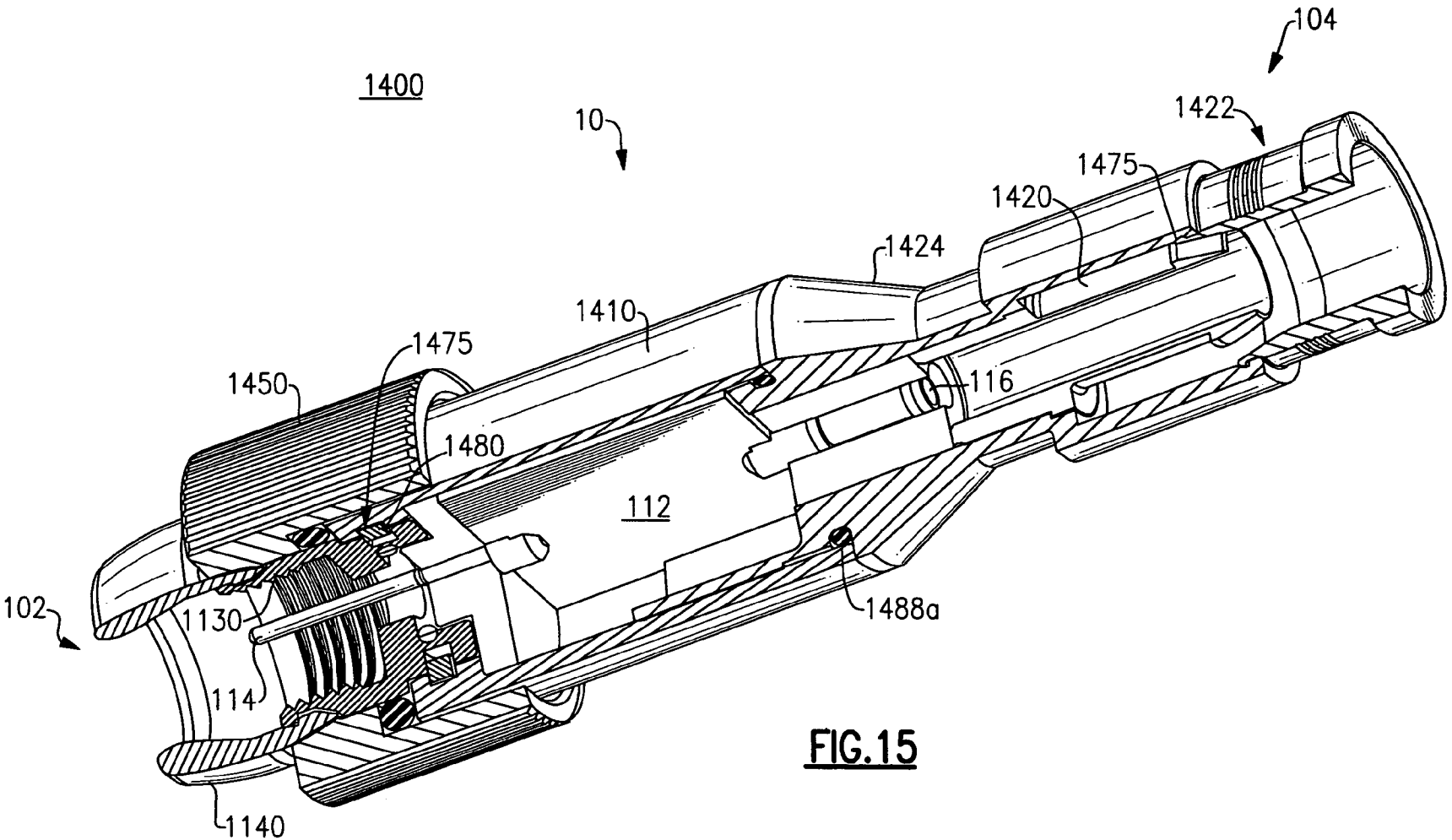
FIG. 15 is a cut-away perspective view of the assembled and uncompressed integrated filter connector of FIG. 14.

FIG. 14 is an exploded perspective view of a tenth embodiment 1400 of an unassembled integrated filter connector 10 made in accordance with the present invention. FIG. 15 is a cut-away perspective view of the assembled and uncompressed integrated filter connector 1400 of FIG. 14.

Figure 16:
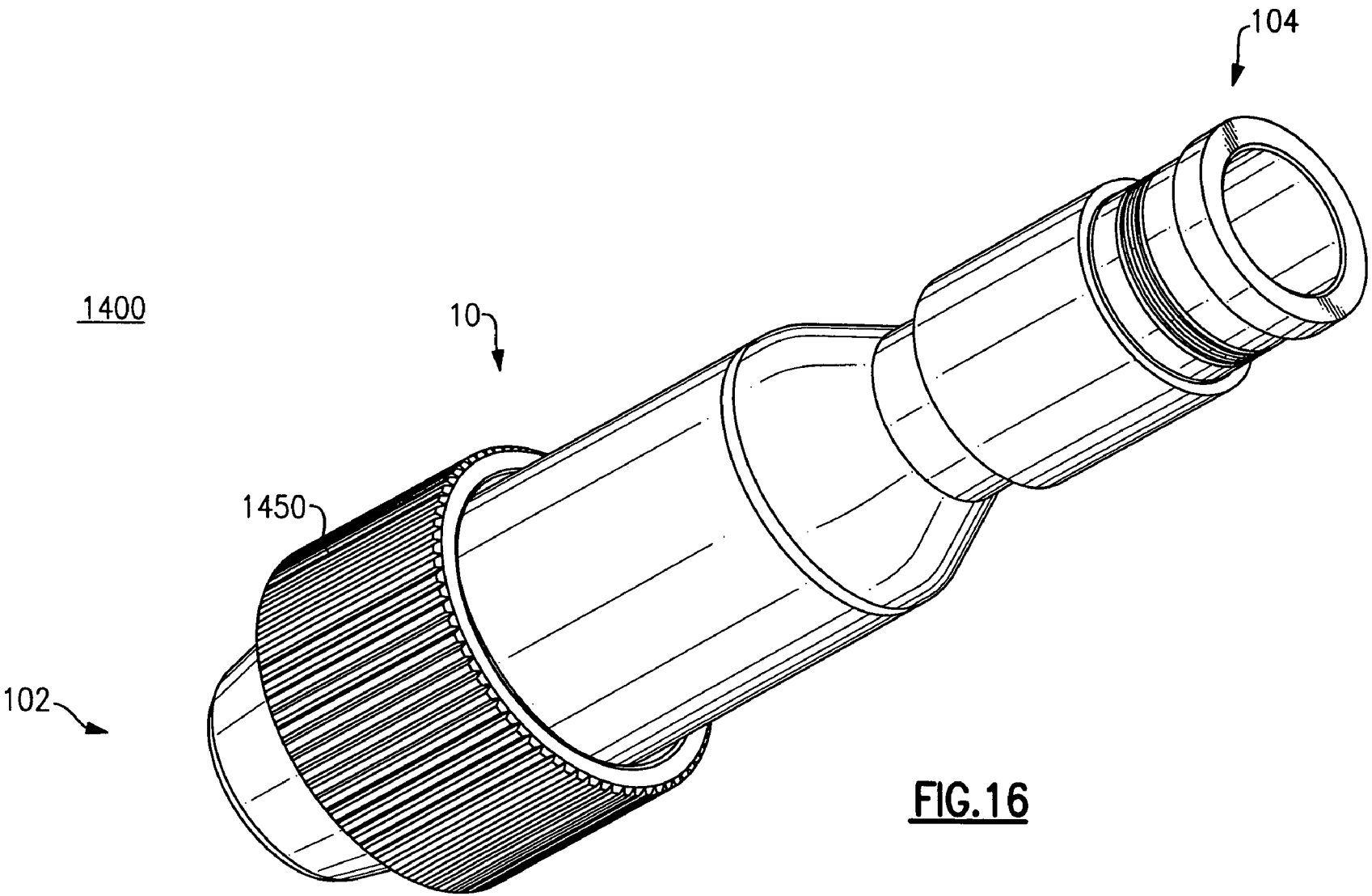
FIG. 16 is a perspective view of the assembled and uncompressed integrated filter connector of FIGS. 14 and 15.

FIG. 16 is a perspective view of the assembled and uncompressed integrated filter connector 10 of FIGS. 14 and 15. As shown, the integrated filter connector 10 includes a forward end 102, a rear end 104, a filter body 1410, and a header 1424 which are configured to enclose a printed circuit board (PCB) 112 that performs in-line signal conditioning and that functions as part of an integrated signal filter assembly. The tenth embodiment is similar to the ninth embodiment in many ways, however, the tenth embodiment eliminates the cylindrical inner body 1118 and incorporates many of the features of the forward header 1176 into the filter body 1410. As the present embodiment eliminates components from the previous embodiment, fewer O-rings are required to seal the potential paths of moisture infiltration.

As in the previous embodiment, the circuit board 112 includes a forward electrode 114 and a rear electrode 116. The forward electrode is implemented as a contact pin 114 and the rear electrode is implemented as a collet 116. The PCB 112 also includes a ground plane (not shown), a forward electrical contact pad (not shown) and a rear electrical contact pad (not shown) at each of two opposite ends. The forward electrical contact pad is in electrical contact with the forward electrode 114. The rear electrical contact pad is in electrical contact with the rear electrode 116. A forward insulator 1172 is configured to surround and electrically isolate the forward contact pin 114 from the filter body 1410. A rear insulator 1178 is configured to surround and electrically isolate the rear contact pin 116 from the header 1424. As shown, the forward insulator 1172 is shaped as a disk, and the rear insulator 1178 is shaped as a cylindrical sleeve.

As assembled, the filter body 1410 is capped by header 1424, also referred to as a rear header 1424. The header 1424 is press fit into the open rear end of the filter body. The header 1424 may include a groove to seat a first O-ring seal 1488*a*. Opposing longitudinal slots 1482*a* and 1482*b* (not shown) are positioned to receive and support the sides of the PCB 112. The ground plane of the circuit board 112 may be electrically engaged by the longitudinal slots 1482*a*-1482*b* in the header 1424. The header 1424 has an inner surface defining a central throughbore. The inner surface includes an internal groove 1475 for the partial seating of the locking member 1422. The inner surface of the header 1424 may also be configured to receive the rear insulator 1178. The inner surface of the header 1424 is also configured to receive a post 1420 which is configured and operates in the same manner as post 1120 in the ninth embodiment described above.

A locking member 1422 is similarly dimensioned and configured to be inserted into the central throughbore of the rear header 1424. The locking member has substantially the same structure and operation as the locking member 1122 in the previous embodiment.

The filter body 1410 has an inner surface defining a central throughbore. The inner surface near the forward end of the filter body 1410 includes an internal groove 1475 (See FIG. 15) for the partial seating of the locking snap ring 1180. The forward end of the filter body receives a nut 1130 which is configured and operates in the same manner as nut 1130 in the ninth embodiment described above. The inner surface at the forward end of the nut 1130 includes internal threads for mating with a threaded port or other fixture having corresponding external threads. The external surface of the rear end of the nut 1130 includes a groove for partially receiving the locking snap ring 1480. With the snap ring 1480 partially seated in both grooves 1475 and 1134, the nut 1130 is engaged with the filter body 1410, but rotates independently thereof.

A grip ring 1450 is press fit over a portion of the external surface of the nut 1130. The press fit is sufficiently tight such that rotation of the grip ring 1450 causes rotation of the nut 1130. As shown, the grip ring 1450 has a knurled outer surface 1450*a* that enables a person to hand tighten the filter connector 10 to a port, such as to a CATV port. The integrated filter connector 10 may also include a port seal 1140 which is attached to the forward end of the nut 1130 to prevent the ingress of moisture along the threaded port and between the nut 1130 and the grip ring 1450. In the present embodiment, the port seal 1140 is a bellows-type seal described above.

In the present embodiment, the nut 1130 has a seal grasping surface which includes an external groove 1136 on the forward end of the nut 1130. The port seal 1140 may also be configured with an internal shoulder at the rear end of the seal that engages the forward side wall of the groove 1136. The grip ring 1450 may also be configured to engage the rear portion of the port seal 1140. The engagement of the port seal 1140 assists in both retaining the port seal 1140 as an integral part of the assembly 10 and in forming a seal to prevent the infiltration of moisture between the nut 1130 and the grip ring 1450.

Sealing members may be disposed between the components at the forward end of the integrated filter connector 10 to seal any potential paths for moisture infiltration. Shoulders, grooves or annular spaces are formed in the respective components to properly seat the sealing members. As depicted in FIGS. 14 and 15, two sealing members in the form of O-rings 1488*b*-1488*c* are disposed at the forward end 102 of the assembly. Sealing member 1488*b* is disposed between the forward insulator 1172 and the inner surface of the filter body 1410. Sealing member 1488*c* is disposed between the nut 1130 and grip ring 1450 at the forward end of the filter body 1410.

Once installed on a cable, a person can hand grip and rotate the grip ring 1450 to rotate the nut 1130 (not shown). The nut 1130 can be rotated to selectively engage or disengage the integrated filter connector 10, to or from an externally threaded port (not shown), such as included within a CATV distribution box.

Figure 17:
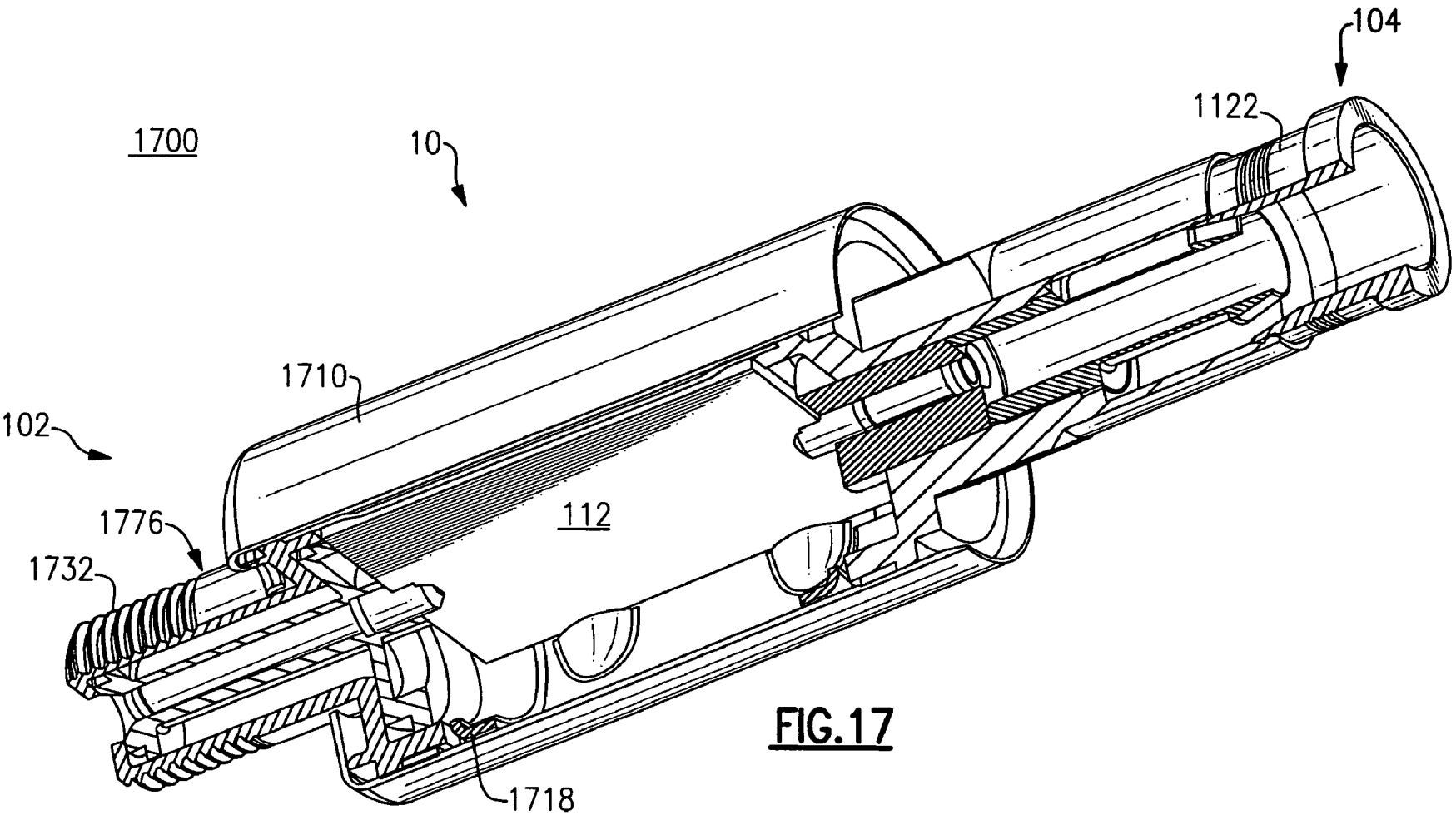
FIG. 17 is a cut-away perspective view of an eleventh embodiment of an assembled and uncompressed integrated filter connector having an externally threaded port connector.

FIG. 17 is a cut-away perspective view of an eleventh embodiment of the assembled and uncompressed integrated filter connector 10 having an externally threaded port connector 1732. The nut 1130 of FIG. 14 is substituted with the externally threaded (female) port connector 1732 that is integrally formed with a forward header 1776. The forward header 1776 is press fitted into the forward end of the cylindrical inner body 1718 and outer body 1710 is slid over the assembled inner body 1718 and forward and rear headers disposed adjacent to the forward and rear ends of the inner body 1718. In this embodiment, as is well known in the art, each end of the outer body is rolled around the forward and rear headers to enclose O-rings (not shown) used to seal each end of the assembly.

While the present invention has been particularly shown and described with reference to the preferred mode as illustrated in the drawings, it will be understood by one skilled in the art that various changes in detail may be effected therein without departing from the spirit and scope of the invention as defined by the following claims.

The invention claimed is:

1. A coax cable connector and filter assembly for coupling an end of a coaxial cable to a port, the coaxial cable having a center conductor surrounded by a dielectric layer, the dielectric layer being surrounded by an electrically conductive material, and the conductive material being surrounded by a protective outer jacket, the connector and filter assembly comprising:

a connector body having a front body end and a rear body end and an internal surface defining a central passageway there between;

an electrical circuit having a front terminal at a first electrical end and a rear terminal at a second electrical end, the electrical circuit located within the central passageway;

a post having a front post end and a rear post end, the front post end disposed within the central passageway and the rear post end adapted to engage the electrically conductive material;

a compression member assembly having a front end and a rear end, and a throughbore, the front end configured for engagement with the inner surface of the central passageway, the rear end of the compression member assembly including a compression member being moveable with respect to the connector body from a first position permitting the insertion of the coaxial cable into the connector body to a second position to grasp the outer sheath of the coaxial cable;

the front body end configured for attachment to a coaxial port; and a compression member cover surrounding a rear end of the compression member.

2. The connector and filter assembly of claim 1 where the compression member assembly further comprises an insert sleeve.

3. A filter assembly, comprising:

a printed circuit board having a filtering circuit and a ground plane thereon, the printed circuit board having two opposite ends, each opposite end of the printed circuit board having an electrical contact pad;

a front terminal and a rear terminal are electrically connected at each of the electrical contact pads at opposite ends of the printed circuit board, said rear terminal including a collet adapted to receive a central conductor of a coaxial cable;

a body having a front end, a rear end and an internal surface defining a central passageway there between, the central passageway receiving the printed circuit board;

a post having a front end and a rear end, the rear end adapted to engage an outer conductor of the coaxial cable, the front end disposed within the central passageway of the body;

a compression member having a front end, a rear end, and a throughbore, said rear end configured for engagement with the inner surface at the rear end of the body, the compression member being moveable with respect to said body from a first position permitting the insertion of a coaxial cable into the central passageway of the body to a second position grasping the outer layers of said coaxial cable; and said front end being configured for attachment of the body to a port;

wherein the rear end of the post is adapted to be inserted beneath the outer conductor of the coaxial cable; wherein the rear end of the post further includes a barbed portion.

4. The filter assembly of claim 3 further comprising a compression member cover surrounding the front end of the compression member.

5. The filter assembly of claim 4 further comprising an insert sleeve.

6. The filter assembly of claim 5 wherein the insert sleeve has an outwardly tapered rear end whereby, upon movement of the compression member to the second position, the compression member is inwardly radially deformed to compress the outer layers of the coaxial cable between the compression member and the barbed portion of the post.

7. A filter assembly, comprising:

a printed circuit board having a filtering circuit and a ground plane thereon, the printed circuit board having two opposite ends, each opposite end of the printed circuit board having an electrical contact pad;

a front terminal and a rear terminal are electrically connected at each of the electrical contact pads at opposite ends of the printed circuit board, said rear terminal including a collet adapted to receive a central conductor of a coaxial cable;

a body having a front end, a rear end and an internal surface defining a central passageway there between, the central passageway receiving the printed circuit board;

a post having a front end and a rear end, the rear end adapted to engage an outer conductor of the coaxial cable, the front end disposed within the central passageway of the body;

a compression member having a front end, a rear end, and a throughbore, said rear end configured for engagement with the inner surface at the rear end of the body, the compression member being moveable with respect to said body from a first position permitting the insertion of a coaxial cable into the central passageway of the body to a second position grasping the outer layers of said coaxial cable;

said front end being configured for attachment of the body to a port and to rotate independently of said body;

a nut and a nut retaining ring; and a first groove on an internal surface of the nut, a second groove on an exterior surface of the body and the nut retaining ring disposed between said first and second grooves.

8. A filter assembly, comprising:

a printed circuit board having a filtering circuit and a ground plane thereon, the printed circuit board having two opposite ends, each opposite end of the printed circuit board having an electrical contact pad;

a front terminal and a rear terminal are electrically connected at each of the electrical contact pads at opposite ends of the printed circuit board, said rear terminal including a collet adapted to receive a central conductor of a coaxial cable;

a body having a front end, a rear end and an internal surface defining a central passageway there between, the central passageway receiving the printed circuit board;

a post having a front end and a rear end, the rear end adapted to engage an outer conductor of the coaxial cable, the front end disposed within the central passageway of the body;

a compression member having a front end, a rear end, and a throughbore, said rear end configured for engagement with the inner surface at the rear end of the body, the compression member being moveable with respect to said body from a first position permitting the insertion of a coaxial cable into the central passageway of the body to a second position grasping the outer layers of said coaxial cable; and said front end being configured for attachment of the body to a port;

wherein the front end of the compression member includes an external flange configured to engage an edge at the rear end of the body for preventing further advancement of the compression member.

9. A filter assembly comprising:

a printed circuit board having two contacts;

a body having a front end, a rear end and structure supporting the printed circuit board, said rear end having a sleeve for receiving a prepared end of a coaxial cable, said coaxial cable having a center conductor surrounded by a dielectric layer, the dielectric layer being surrounded by an electrically conductive material, and the conductive material being surrounded by a protective outer jacket;

a post at least partially disposed within the sleeve configured for engagement with the outer conductor of the cable;

a cable compression mechanism adapted to engage and grasp the outer jacket of the cable;

a collet electrically engaged to the first contact and adapted to receive the center conductor of a coaxial cable;

an insulator electrically isolating at least one contact from the body; and a connector interface at the front end of the body adapted to engage a port.

10. The filter assembly of claim 9, wherein the body comprises a cylindrical housing and a header.

11. The filter assembly of claim 10 further comprising second insulator to electrically isolate a second contact from the body.

12. The filter assembly of claim 10 wherein a nut is engaged to a header at the front end of the body.

13. The filter assembly of claim 9 wherein the structure supporting the circuit board is a pair of opposing slots in the body.

14. The filter assembly of claim 9 wherein the sleeve is integral to the cylindrical housing.

15. The filter assembly of claim 9 wherein the sleeve is formed on the header.

16. The filter assembly of claim 9 wherein the interface comprises an internally threaded nut.

17. The filter assembly of claim 16 wherein the nut rotates independently of the body.

18. A filter assembly comprising a printed circuit board having a circuit for conditioning an electronic signal transmitted along a coaxial cable; body means for housing and supporting the printed circuit board having a front end and a rear end; cable compression means at the rear end of the body for receiving and grasping a prepared end of a coaxial cable having a central conductor; conductor receiving means for electrically engaging the central conductor to the printed circuit board; insulating means for electrically isolating the conductor receiving means from the body means; and interface means for connecting the first end of the body to a port;

wherein cable compression means includes a sleeve at the rear end of the body adapted to receive the coaxial cable;

further comprising means for electrically engaging an outer conductor of the cable;

wherein the means for electrically engaging the outer conductor includes a post disposed at least partially within the sleeve.

19. The filter assembly of claim 18 wherein the cable compression means further includes a compression member adapted to be inserted into said sleeve.

20. The filter assembly of claim 18 wherein the interface means includes a nut rotatably engaged to the front end of the body.

21. The filter assembly of claim 18 wherein the body means includes a cylindrical housing and a header.

* * * * *